US005711476A

United States Patent [19]

Fujimoto (Nee: Fujimoto) et al.

[11] Patent Number: 5,711,476

[45] Date of Patent: Jan. 27, 1998

[54] CARTON FOR GRANULAR MATERIALS

[75] Inventors: Kanna Ueda Fujimoto (Nee: Fujimoto); Yukio Nanno, both of Kobe, Japan

[73] Assignee: The Procter & Gamble Company, Cincinnati, Ohio

[21] Appl. No.: 680,471

[22] Filed: Jul. 15, 1996

[51] Int. Cl.[6] ..... B65D 5/475; B65D 5/66

[52] U.S. Cl. ..... 229/125.08; 229/125.05; 229/125.26; 229/125.29; 229/149

[58] Field of Search ..... 229/125.08, 125.11, 229/145, 146, 148, 123.1, 125.05, 125.26, 125.29

[56] References Cited

U.S. PATENT DOCUMENTS

| | | | |
|---|---|---|---|
| 2,570,145 | 10/1951 | Mettler | 229/145 |
| 2,711,282 | 6/1955 | D'Esposito | 229/125.29 |
| 2,847,151 | 8/1958 | Meyer-Jagenberg | 229/125.05 |
| 3,100,074 | 8/1963 | Beck | 229/148 |
| 3,122,299 | 2/1964 | Haas | 229/125.08 |
| 3,326,447 | 6/1967 | Williamson | 229/145 |
| 3,425,616 | 2/1969 | Adams, Jr. | 229/125.08 |
| 3,870,222 | 3/1975 | Butler | 229/125.08 |
| 3,893,614 | 7/1975 | Meyers | 229/145 |
| 3,910,486 | 10/1975 | Stone | 229/145 |
| 4,127,230 | 11/1978 | Bamburg et al. | 229/125.29 |
| 4,215,783 | 8/1980 | Vanderlugt, Jr. | 229/145 |
| 4,215,810 | 8/1980 | Zicko | 229/146 |
| 4,314,643 | 2/1982 | Forbes, Jr. | 229/145 |
| 4,477,015 | 10/1984 | Lozaun | 229/125.08 |
| 4,531,669 | 7/1985 | Osborne | 229/125.26 |
| 4,768,703 | 9/1988 | Sosler et al. | 229/125.05 |
| 4,787,515 | 11/1988 | Stoll | 229/125.08 |
| 5,040,722 | 8/1991 | Fromion et al. | 229/125.29 |
| 5,201,461 | 4/1993 | Sykora | 229/125.08 |
| 5,518,172 | 5/1996 | Nanno | 229/125.05 |

FOREIGN PATENT DOCUMENTS

| | | | |
|---|---|---|---|
| 40/5097138 | 4/1993 | Japan | 229/125.08 |
| 40/5305940 | 11/1993 | Japan | 229/125.08 |
| 6-22725 | 10/1994 | Japan . | |

*Primary Examiner*—Gary E. Elkins

*Attorney, Agent, or Firm*—Elizabeth M. Koch; T. David Reed

[57] ABSTRACT

Disclosed is a carton for containing granular materials comprising a box having front, back and side panels to form an opening and a lid attached to an upper portion of the back panel for closing the opening. The lid comprises (a) a top panel for covering the opening upon closure of the lid, (b) font and side flaps extending fore the respective edges of the top panel for coveting the respective upper portions of the font and side panels upon closure of the lid, (c) an adhesion flap adhering to the back panel, and (d) a back flap attached to the top panel and the adhesion flap. A cutting line which is extending toward the top panel is formed at least in the back flap so that the lid can be opened completely (about 270 degrees from its closed position) without any damage to the carton structure.

8 Claims, 26 Drawing Sheets

CARTON FOR GRANULAR MATERIALS

FIELD OF THE INVENTION

The present invention relates to a carton for containing a granular material such as a granule detergent.

BACKGROUND OF THE INVENTION

A carton which is filled with a granular material such as a powder detergent for containing the same is known in general. Such a carton generally has a box which is filled with the granular material, and a lid for closing an opening of the box. In relation to such a carton, known are that having a box which is integrally provided with a lid, and that having a lid which is formed independently of a box and attached to the box by pasting or the like.

The box is generally prepared from a square one which is provided with an opening on its upper portion and has a front panel, a back panel, side panels and a bottom panel. On the other hand, the lid is generally prepared from that having a top panel covering an upper portion of the opening of the box upon closure, and a front flap, side flaps and a back flap covering upper portions of the front panel, the side panels and the back panel respectively upon closure. In the aforementioned pasted type one, a paste flap is provided on the back panel through a hinge line, so that this paste flap is attached to an upper portion of the back panel of the box through an adhesive.

In a conventional carton having such a pasted type lid, the lid can be opened up to an angle of about 180 degrees from a closed position. In other words, the lid is rotatable at about 180 degrees through the hinge line. Namely, the back flap of the lid comes into contact with the back panel of the box at the angle of 180 degrees, and no further rotation of the lid is allowed. When the lid is further rotated in this state, excessive stress acts on the bonded portion between the paste flap of the lid and the back panel of the box, to cause such a problem that the paste flap is separated from the back panel of the box and detached from the box.

In the conventional pasted type carton, therefore, the lid can be rotated and opened only up to an angle of about 180 degrees from the closed position, and cannot be further rotated and opened without destruction of the carton structure.

SUMMARY OF THE INVENTION

Briefly stated, the carton according to the present invention comprises a box having front, back and side panels to form an opening and a lid attached to an upper portion of the back panel for closing the opening. The lid comprises (a) a top panel for covering the opening upon closure of the lid, (b) front and side flaps extending from the respective edges of the top panel for covering the respective upper portions of the front and side panels upon closure of the lid, (c) an adhesion flap adhering to the back panel, and (d) a back flap attached to the top panel and the adhesion flap. A cutting line which is extending toward the top panel is formed at least in the back flap.

Preferably, the cutting line is so formed as to reach an upper end portion of the back flap.

More referably, the back flap hingedly attached to said adhesion flap through a first hinge line. Preferably, a second hinge line is formed in the back flap above the first hinge line, and the cutting line is formed up to said second hinge line.

More referably, the cutting line is a cutting auxiliary line for aiding an actual cutting during an operation of opening the lid.

DETAILED DESCRIPTION OF THE INVENTION

Figure 1:
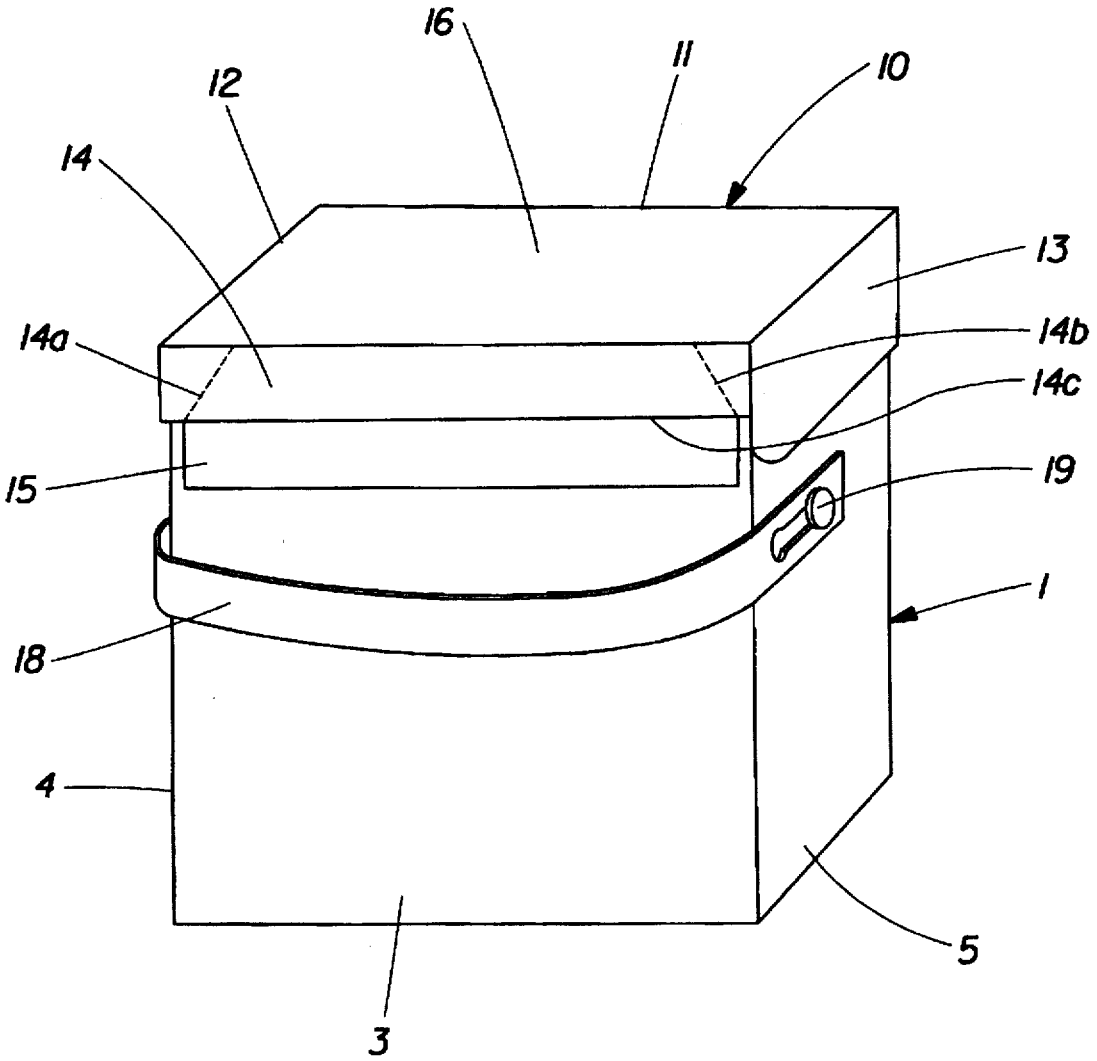
FIG. 1 is a perspective view showing an embodiment according to the first aspect of the present invention.

Referring to FIG. 1, this carton is formed by a box 1 and a lid 10. Preferably, the box 1 and lid 10 are formed by a paperboard member. FIG. 1 shows a perspective view of the carton from behind. The box 1 comprises a front panel 2 (shown in FIG. 2), a back panel 3, side panels 4 and 5 and a bottom panel (not shown), and has an opening on its upper portion. The lid 10 is provided for closing the opening of this box 1.

The lid 10 has a top panel 16 which is positioned on the opening of the box 1 when the lid 10 is closed, a front flap 11 which covers an upper portion of the front panel 2 of the box 1 when the lid 10 is closed, side flaps 12 and 13 which similarly cover upper portions of the side panels 4 and 5, a paste flap 15 is which is pasted on an upper portion of the back panel 3 of the box 1, and a back flap 14 which is provided between the paste flap 15 and the top panel 16.

A hinge line 14c serving as a bending line is formed between the back flap 14 and the paste flap 15. Further, perforations 14a and 14b serving as cutting lines are formed from upper end portions of both sides of the paste flap 15 toward end portions of the top panel 16 respectively. According to this embodiment, the perforations 14a and 14b are inwardly incline to approach to each other toward the end portions of the top panel 16.

The term "cutting line" used herein includes an already cut line which has been already (or actually) cut and an uncut line to be cut, which must be cut during an operation of opening the lid. The term "uncut line" includes a cutting auxiliary line for aiding an actual cutting during the operation of opening the lid. In other words, the cutting auxiliary line causes an actual cut line in response to stress which is generated or caused during the operation of opening the lid. Such a cutting auxiliary line includes a partial cutting line such as a perforation, and a continuous cutting line such as a score line or a semi-cut (or half-cut) line, for example (but not restricted to these). The cutting auxiliary line includes a holding or score line which has a notch at a cutting start point.

Figure 2:
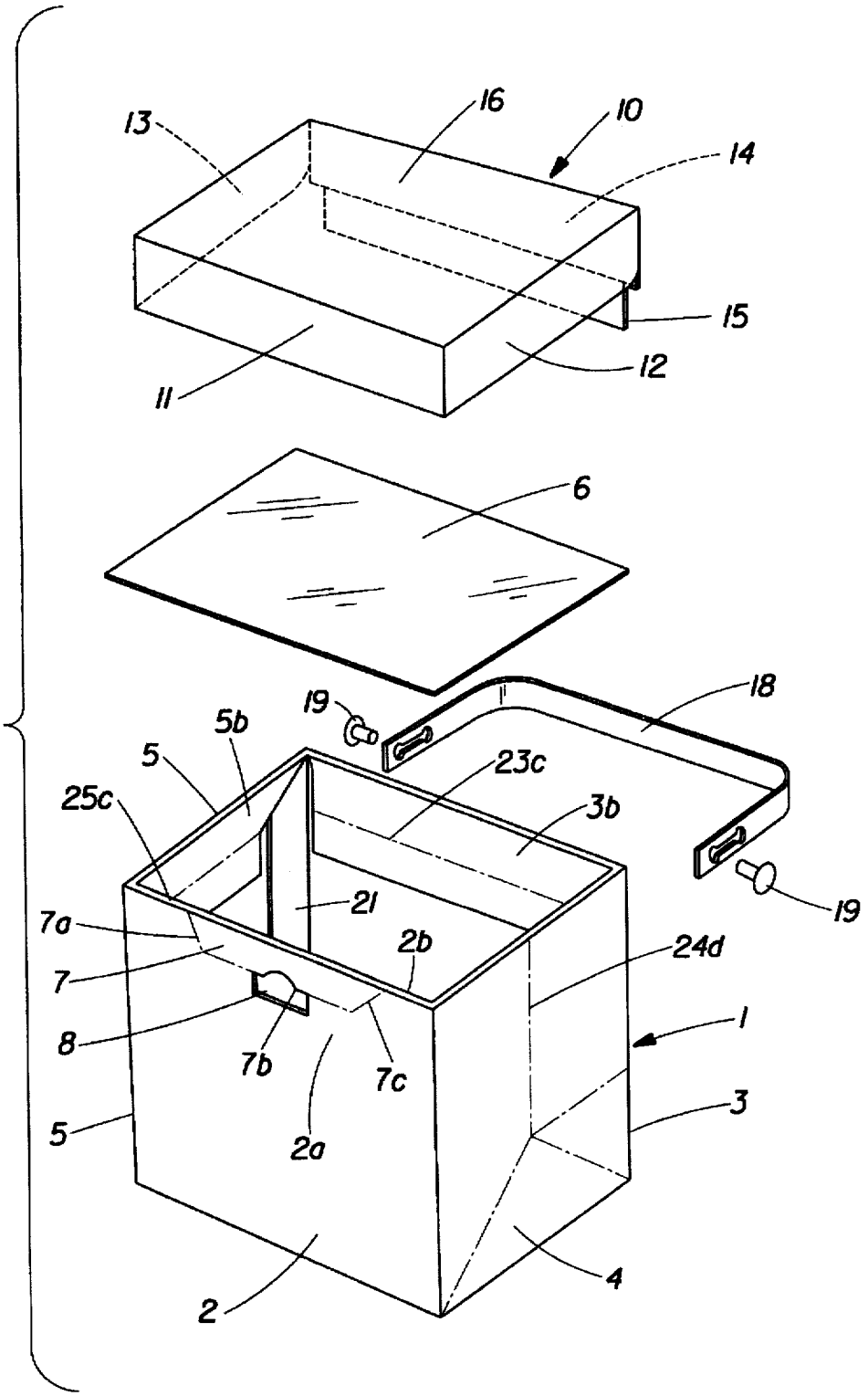
FIG. 2 is an exploded perspective view of the carton shown in FIG. 1.

Referring to FIG. 2, the upper portions of the front panel 2, the back panel 3 and the side panels 4 and 5 of the box 1 are formed by bending cardboard plate members. In the upper portion of the front panel 2, therefore, a surface plate 2a and a rear plate 2b are superposed with each other in a double structure. In this front panel 2, a semi-cut line is formed in a folded portion.

Figure 3:
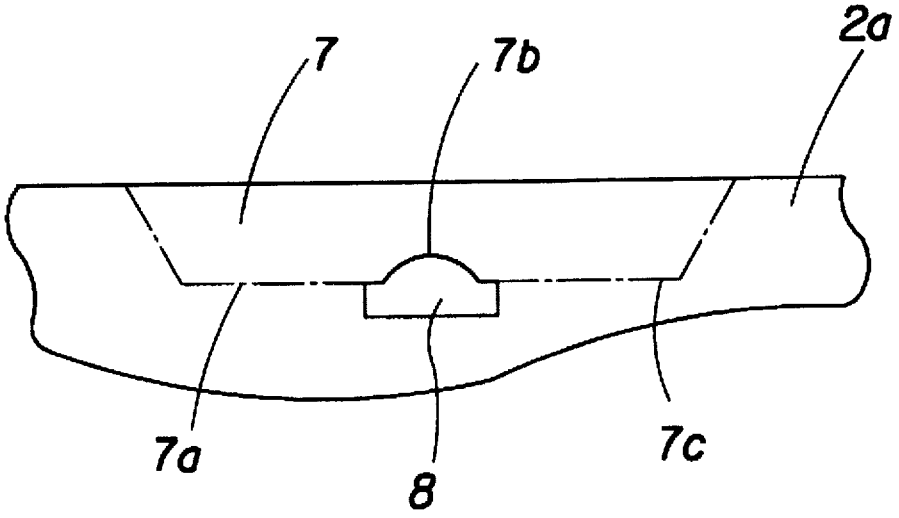
FIG. 3 is a front elevational view showing an upper portion of the box front panel shown in FIG. 2.

In the upper portion of the front panel 2, slits 7a, 7b and 7c are formed in the surface plate 2a as shown in FIG. 3 in an enlarged manner, thereby defining a stop tongue 7. The slits 7a, 7b and 7c are so discontinuously formed that the stop tongue 7 is connected with the surface plate 2a through discontinuous portions. Under the center of the stop tongue 7, an insertion hole 8 is defined by partially cutting out the surface plate 2a. The insertion hole 8 is provided for facilitating insertion of a finger or thumb for uprighting the stop tongue 7.

A rear panel 3b is folded and superposed on the upper portion of the back panel 3. Similarly, a rear panel 5b is folded and superposed also on the upper portion of the side panel 5. Similarly, a rear panel (not shown) is folded and superposed also on the side panel 4.

A handle 18 consisting of synthetic resin or the like is mounted on the side panels 4 and 5 of the box 1. The handle 18 is mounted by passing rivets 19 through holes which are formed on both end portions and attaching these rivets 19 to the side panels 4 and 5. This handle 18 is rotatably mounted. Therefore, the handle 18 can be upwardly rotated, in order to carry the carton.

A seal paper 6 serving as a seal member is pasted on the opening in the upper portion of the box 1. The seal paper 6 can be prepared from a laminate sheet having a structure of sandwiching an OPP (oriented polypropylene) film with thin papers, or that having a structure of sandwiching a PET film with glassine papers. When the seal paper 6 is pasted on the upper portion of the box 1 by hot melting, a laminate sheet having a multilayer structure of a glassine paper, a PET film, a PE film and a hot melting adhesive layer can be employed. Such a seal paper 6 is pasted after the box 1 is filled with the granular material. The stop tongue 7 of the box 1 is not uprighted, and hence the same forms no obstacle at the time of filling the box 1 with the granular material, but enables mechanical filling. Also when the seal paper 6 is pasted, the stop tongue 7 is not uprighted and hence the seal paper 6 can be prevented from being erroneously attached to the stop tongue 7.

The lid 10 is attached to the upper portion of the back panel 3 shown in FIG. 2. Attached to the back panel 3 is the portion of the paste flap 15 of the lid 10 as described above, and this portion is attached by an adhesive or the like. As hereinabove described, the lid 10 is provided with the front flap 11 and the side flaps 12 and 13 covering the upper portions of the front panel 2 and the side panels 4 and 5 respectively when the lid 10 is closed.

Figure 4:
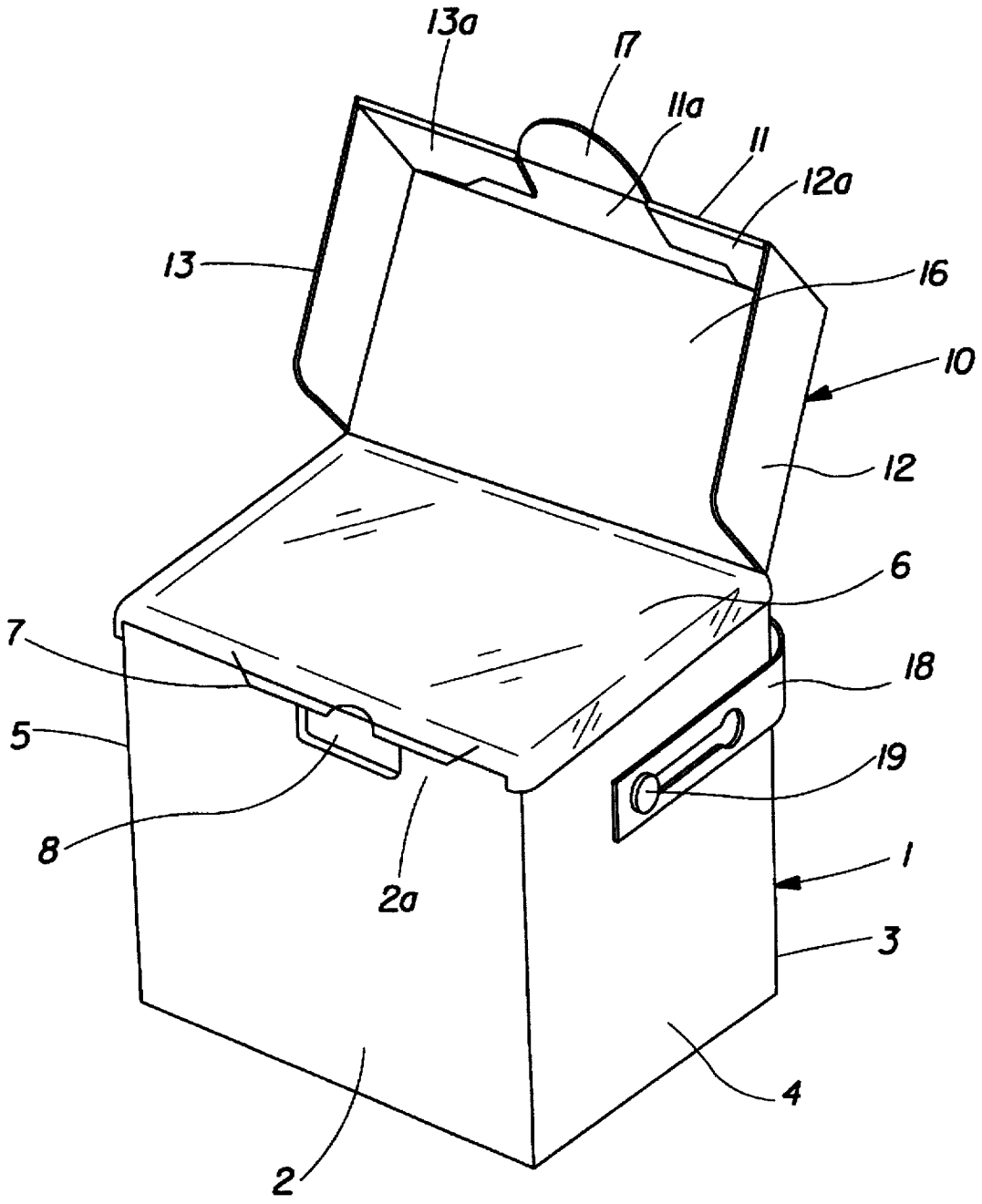
FIG. 4 is a perspective view the carton shown in FIG. 2 when the lid is opened.

FIG. 4 shows such a state that the handle 18 is attached to the box 1 shown in FIG. 2, and the seal paper 6 is pasted on the upper portion of the box 1, thereby attaching the lid 10. As shown in FIG. 4, the stop tongue 7 is not in an uprighted state but in a positional state along the surface panel 2a, when the seal paper 6 is attached. Therefore, the consumer will not erroneously recognize the stop tongue 7 as a tab for removing the seal paper 6. The lid 10 is kept in a closed state by an adhesive seal 17.

Figure 5:
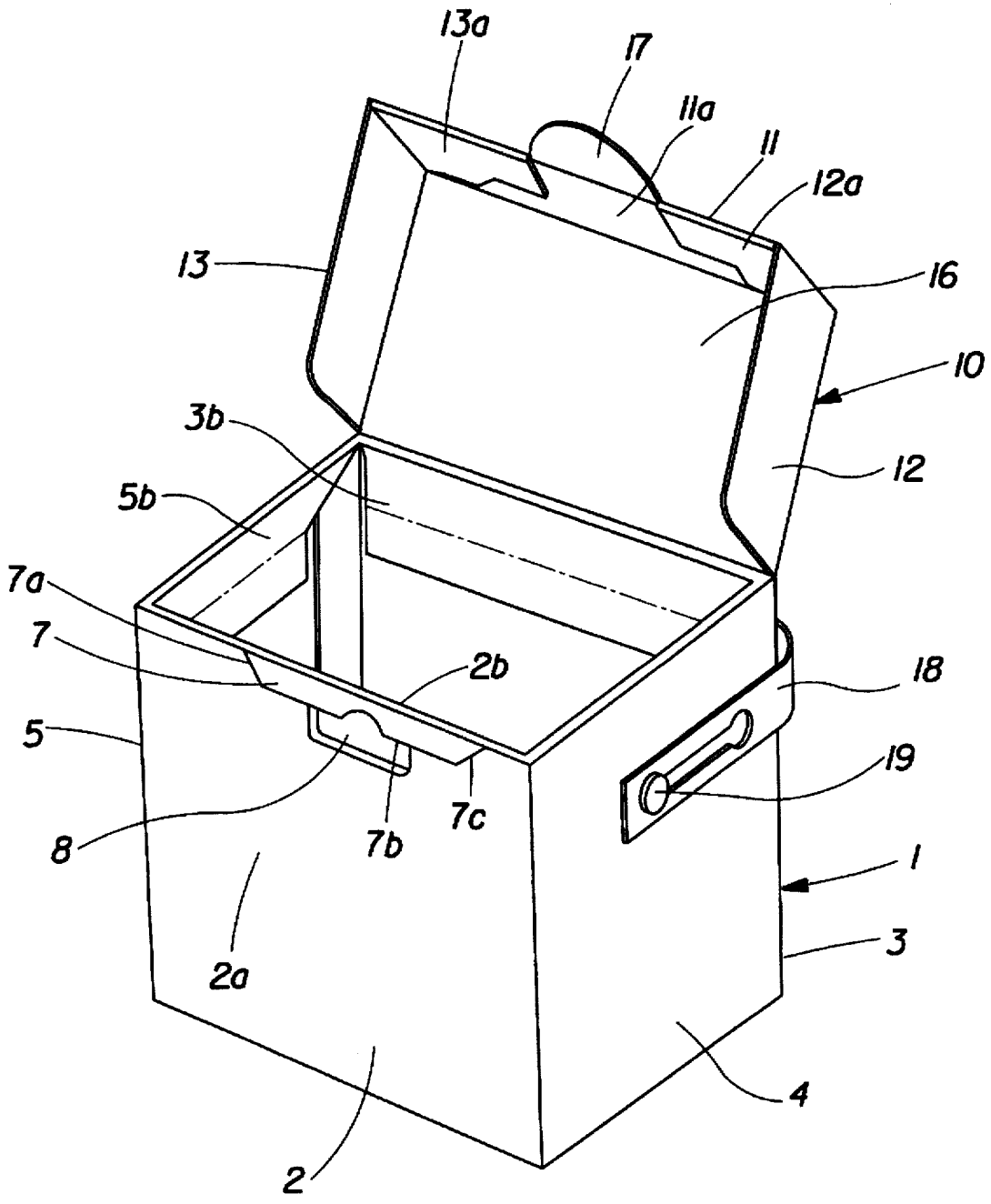
FIG. 5 is a perspective view of the carton shown in FIG. 4 after removing a seal member.
Figure 6:
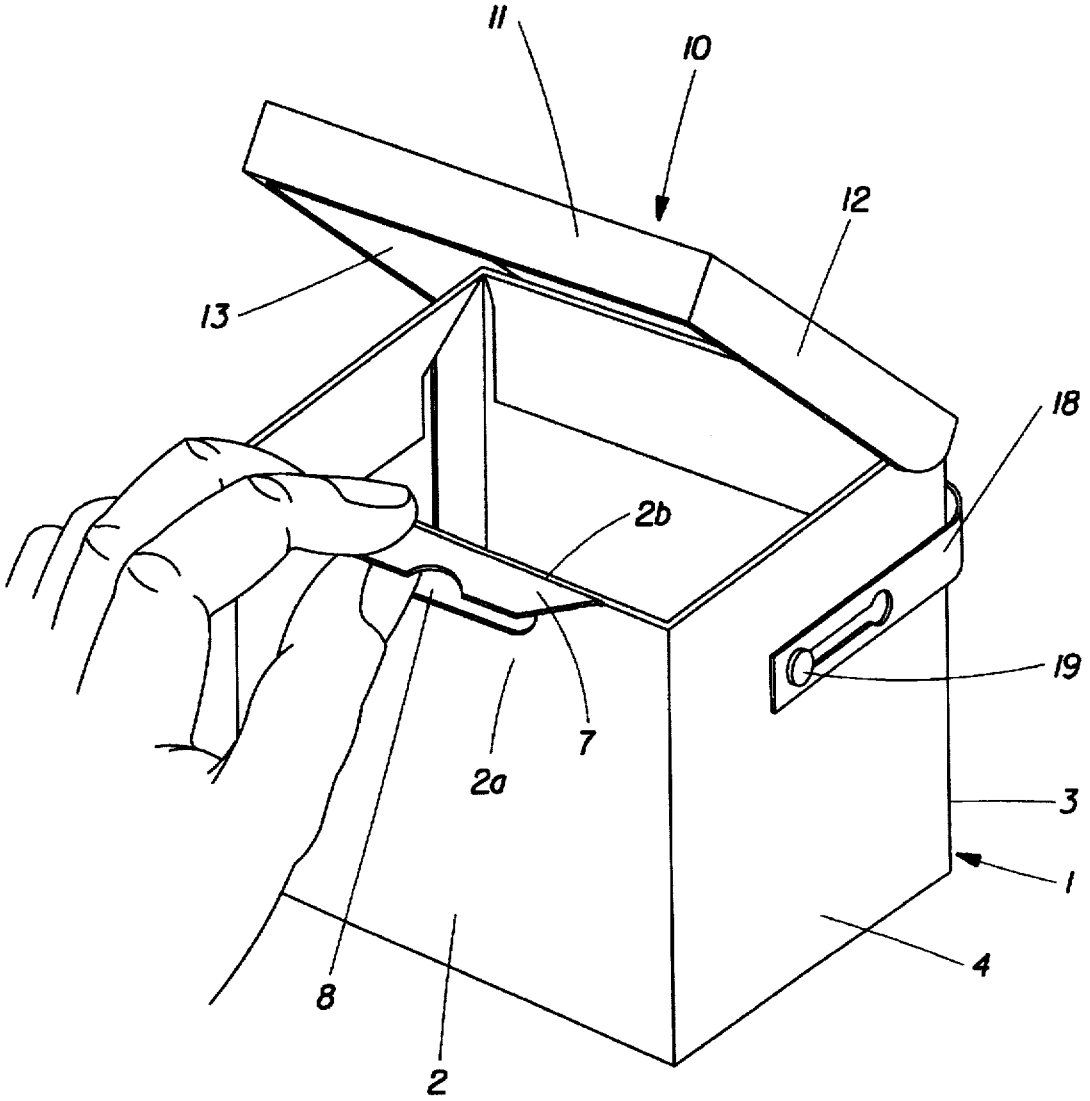
FIG. 6 is a perspective view showing a state of uprighting a stop tongue in the carton shown in FIG. 5.

FIG. 5 shows a state where the seal paper 6 and the adhesive seal 17 are removed from the state shown in FIG. 4. Thus, the consumer first removes the seal paper 6. Then, he inserts his thumb in the insertion hole 8 and pulls the stop tongue 7, thereby uprighting the stop tongue 7 with respect to the surface panel 2a, as shown in FIG. 6. At this time, the discontinuous portions between the slits 7a and 7b and between the slits 7b and 7c are cut to bring the slits 7a to 7c into a continuous state, thereby defining the stop tongue 7 which is rotatable about the upper end portion of the surface panel 2a. Such a stop tongue 7 frontwardly projects due to the elastic force of the cardboard, whereby the stop tongue 7 engages in a stop cavity 11a which is provided on the rear side of the from flap 11 of the lid 10 when the lid 10 is rotated and closed, to stop the lid 10. Thus, a locked state of the lid 10 is implemented.

When the lid 10 is opened, the lid 10 is pulled up to be rotated in an opening direction, so that the rotatable stop tongue 7 is upwardly rotated while the upper end portion of the front panel 2 is slightly inwardly depressed, whereby the stop tongue 7 is separated from the stop cavity 11a for releasing the lid 10 from the locked state.

Figure 7:
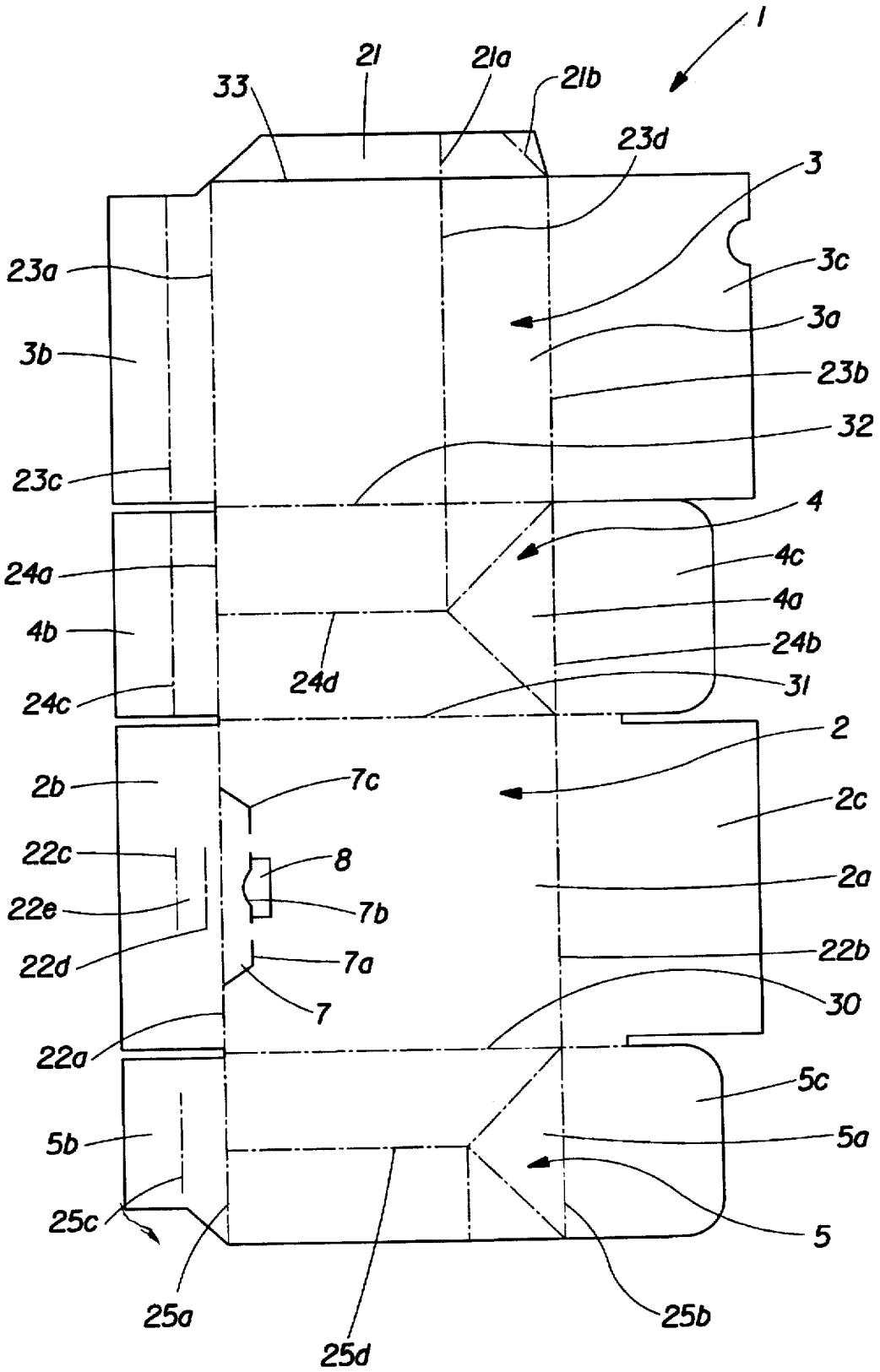
FIG. 7 is a development of the carton shown in FIG. 1.

Referring to FIG. 7, the box 1 is formed by a single cardboard plate member in which the side panel 5, the front panel 2, the side panel 4, the back panel 2 and a paste panel 21 are connected with each other. One-dot chain lines shown in FIG. 7 indicate folding lines. In the front panel 2, the rear panel 2b is provided in continuation to the surface panel 2a through a folding line 22a, and a bottom panel 2c is provided in continuation to the surface panel 2a through a folding line 22b. The front panel 2 is provided with the slits 7a, 7b and 7c for defining the stop tongue 7. The portion of the insertion hole 8 is in a cut-out state. The rear panel 2b of the front panel 2 is provided with folding lines 22c and 22d. These folding lines 22c and 22d are arranged in positions which correspond to the insertion hole 8 when the rear panel 2b is folded along the folding line 22a. Due to the formation of these folding lines 22c and 22d, an inwardly swelling cavity 22e is defined. Further, a semi-cut line is cut in the folding line 22a.

The side panel 5 is provided in continuation to the front panel 2 through a folding line 30. The rear panel 5b and the bottom panel 5c are provided in continuation to the surface panel 5a of the side panel 5 through folding lines 25a and 25b respectively. The rear panel 5b is provided with a folding line 25c. Four folding lines 25d are formed on the surface panel 5a of the side plate 5, as shown in FIG. 7. These folding lines 25d are used for folding the container after employment.

The side panel 4 is provided in continuation to the front panel 2 through a folding line 31. Rear and bottom panels 4b and 4c are formed on both end portions of the surface panel 4a of the side panel 4 through folding lines 24a and 24b respectively. A folding line 24c is formed on the rear panel 4b. Four folding lines 24d are formed on the surface panel 4a of the side panel 4, as shown in FIG. 7. These folding lines 24d are also used for folding the container after employment, similarly to the folding lines 25d.

The back panel 3 is provided in continuation to the side panel 4 through a folding line 32. Rear and bottom panels 3b and 3c are provided in continuation to both end portions of the surface panel 3a of the back panel 3 through folding lines 23a and 23b. A folding line 23c is formed on the surface panel 3b. The surface panel 3a is provided with a folding line 23d which is connected with one of the folding lines 24d. This folding line 23d is also used for folding the container after employment, similarly to the folding lines 24d and 25d.

The paste panel 21 is provided in continuation to the back panel 3 through a folding line 33. This paste panel 21 is bonded and attached to an end portion of the surface panel 5a of the side panel 5. The paste panel 21 is provided with folding lines 21a and 21b, which are used for folding the container after employment, similarly to the folding lines 23d to 25d.

Figure 8:
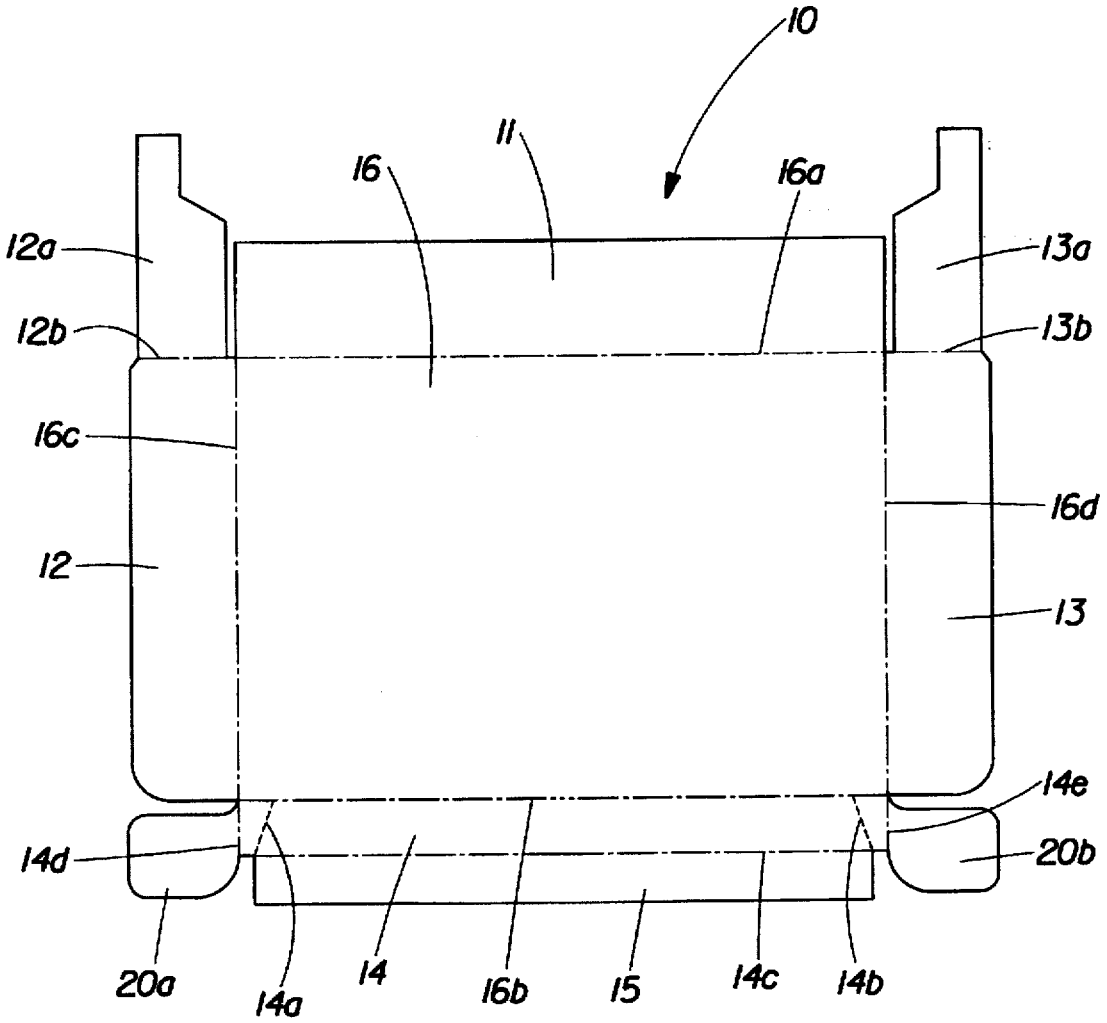
FIG. 8 is a development of the lid of the carton shown in FIG. 1.

As shown in FIG. 8, the front flap 11, the back flap 14 and the side flaps 12 and 13 are provided in continuation to four portions of the top panel 16 through folding lines 16a, 16b, 16c and 16d. The paste flap 15 is provided in continuation to the back flap 14 through the hinge line 14c, which is a folding line. The perforations 14a and 14b, which are cutting lines toward the folding line 16b, are formed from positions where outer edge portions of the paste flap 15 are in contact with lower end portions of the back flap 14. While the hinge line 14c is formed as a folding line, a partially cut perforation or semi-cut line may alternatively be provided, for example, in order to further facilitate bending.

Auxiliary flaps 20a and 20b are provided in continuation to the back flap 14 through folding lines 14d and 14e respectively.

Auxiliary flaps 12a and 13a are provided in continuation to the side flaps 12 and 13 through folding lines 12b and 13b respectively. The auxiliary flaps 12a and 13a are bonded to the rear side of the front flap 11 when the lid 10 is assembled by folding the material therefor along the folding lines 16a to 16d, thereby defining the stop cavity 11a as shown in FIG. 4. The auxiliary flaps 20a and 20b are bonded to the inner sides of the side flaps 12 and 13 respectively upon assembling.

When the lid 10 shown in FIG. 8 is assembled and the paste flap 15 is pasted on the upper portion of the back panel 3 of the box 1, the lid 10 is attached to the box 8 to provide the carton shown in FIG. 1. Referring to FIG. 1, the lid 10 is rotated about the hinge line 14c provided between the back flange 14 and the paste flap 15 when the lid 10 is opened.

Figure 9:
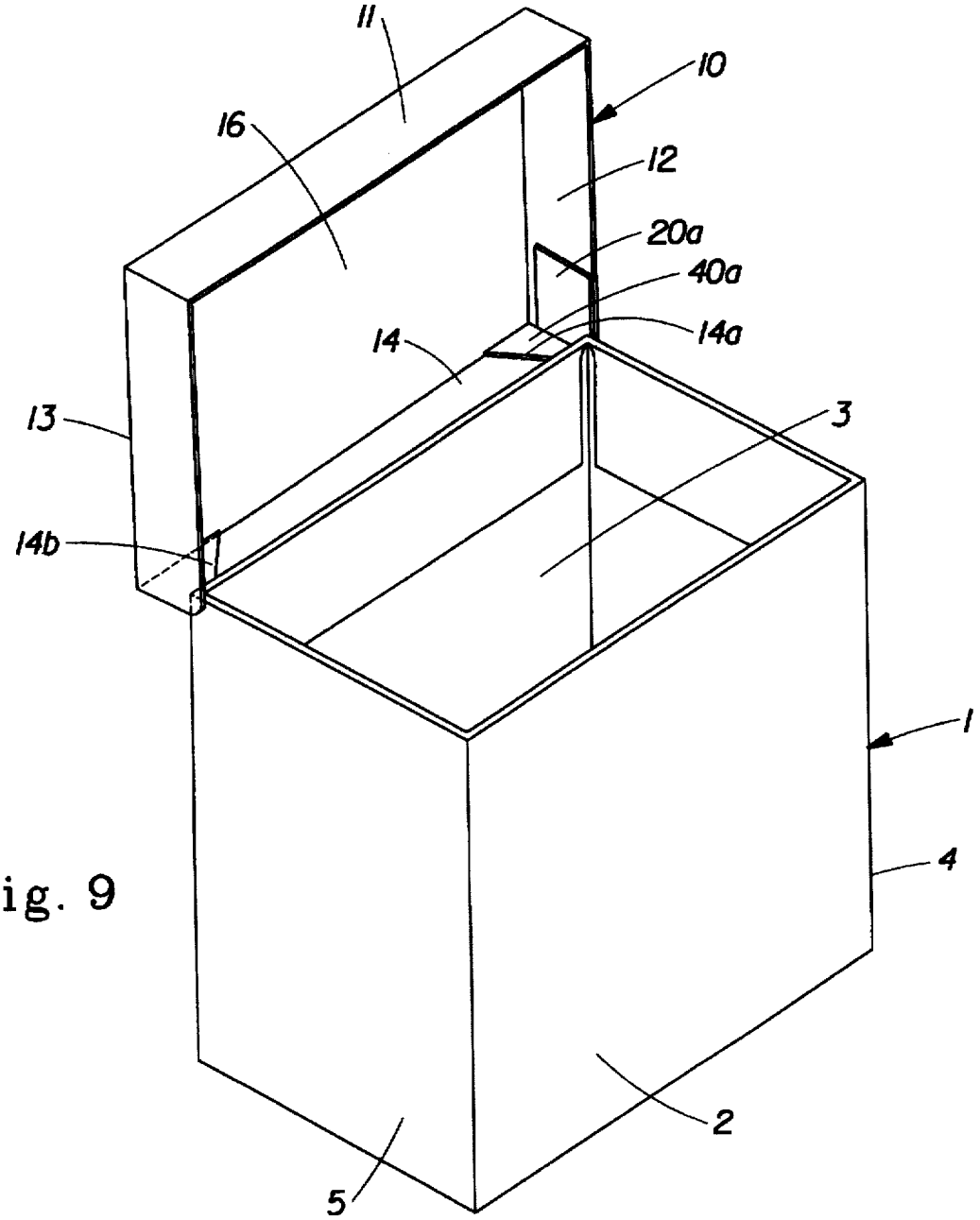
FIG. 9 is a perspective view showing a state of opening the lid shown in FIG. 1.

FIG. 9 is a perspective view showing a state where the lid 10 is rotated up to an angle of about 90 from the upper end of the opening of the box 1 and opened. When the lid 10 is first opened in the range of about 90, the perforations 14a and 14b of the back flap 14 define no cut lines (already cut lines). Namely, the same still remain in the states of perforations. When the lid 10 is further opened beyond 90, stress starts to act on the back flap 14 in a substantially horizontal state of the lid 10, i.e., in a state opened to an angle of 180 degrees. When the lid 10 is further rotated in this state, connecting portions in the perforations 14a and 14b are gradually cut by the stress acting through the rotation, whereby the perforations 14a and 14b are completely cut. Namely, complete cut lines are defined.

Figure 10:
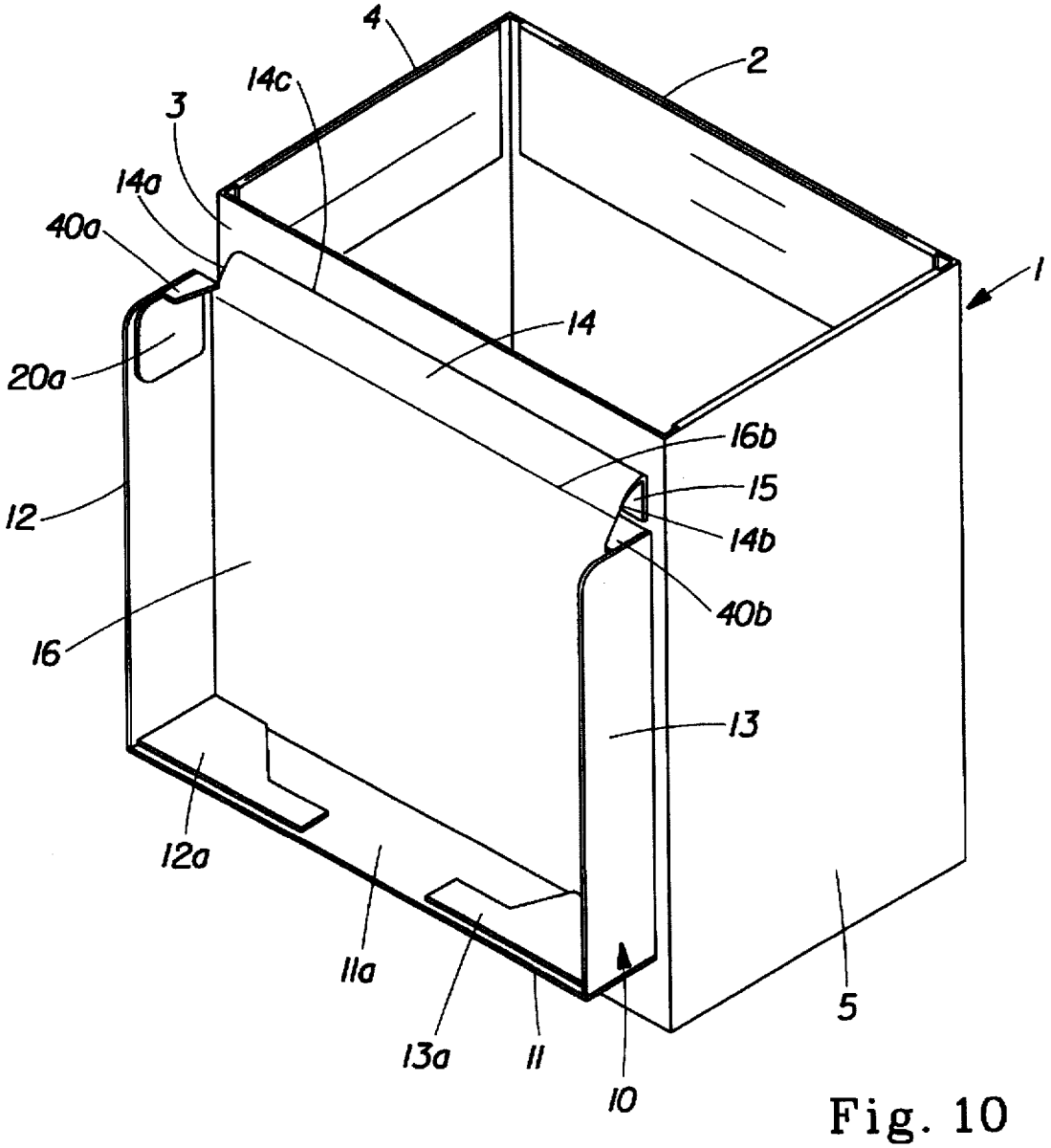
FIG. 10 is a perspective view showing a state of fully opening the lid shown in FIG. 1.

FIG. 10 shows such a state that the lid 10 is further rotated so that the top panel 16 of the lid 10 substantially comes into contact with the back panel 3 of the box 1. As shown in FIG. 10, the portions of the perforations 14a and 14b are completely cut so that rest members 40a and 40b are left on both end portions of the back flap 14 on the lid 10 side.

As shown in FIG. 10, the lid 10 can be rotated about the folding line 16b provided between the top panel 16 and the back flap 14, due to complete cutting of the perforations 14a and 14b. After the complete cut lines are defined, therefore, no stress is caused by further opening (up to 270 degrees) of the lid 10. Thus, no stress acts on the paste flap 15 and hence separation of the paste flap 15 from the back panel 3 can be prevented.

Figure 11:
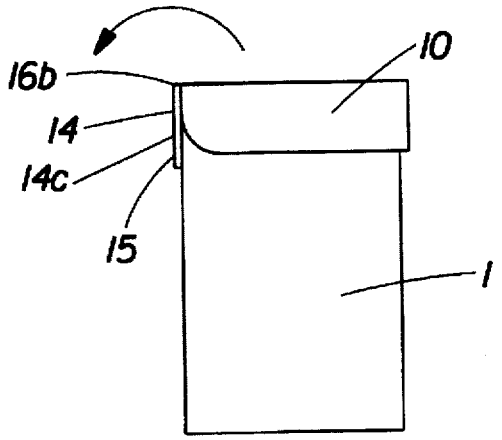
FIGS. 11 to 13 are side elevational views for illustrating states of rotation of the lid in the embodiment according to the first aspect of the present invention.

FIG. 11 shows a closed state of the lid 10. When the lid 10 is rotated along arrow from this state, the lid 10 is first rotated about the hinge line 14c.

Figure 12:
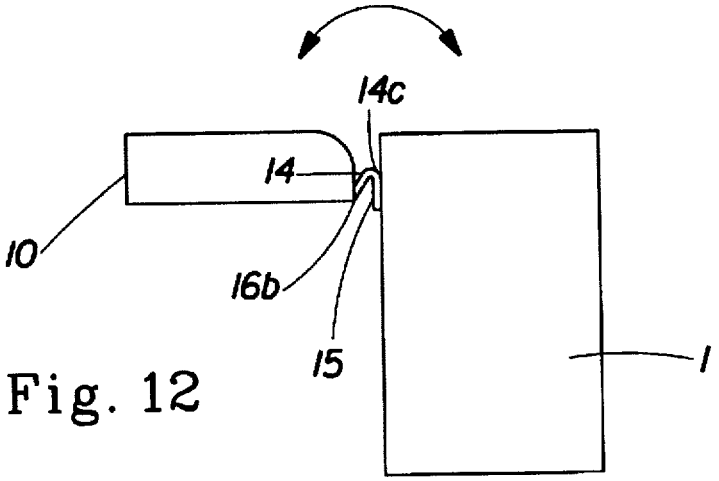

FIG. 12 shows a state where the lid 10 is opened to a substantially horizontal direction, i.e., opened to an angle of about 180 degrees from a closed position. Stress caused by the rotation of the lid 10 gradually starts to act on the back flap 14 from this state, and complete cut lines are defined along the perforations 14a and 14b as described above. Thus, the back flap 14 and the lid 10 enter foldable flexible states along the folding line 16b. Therefore, the lid 10 is further rotatable about the folding line 16b.

Figure 13:
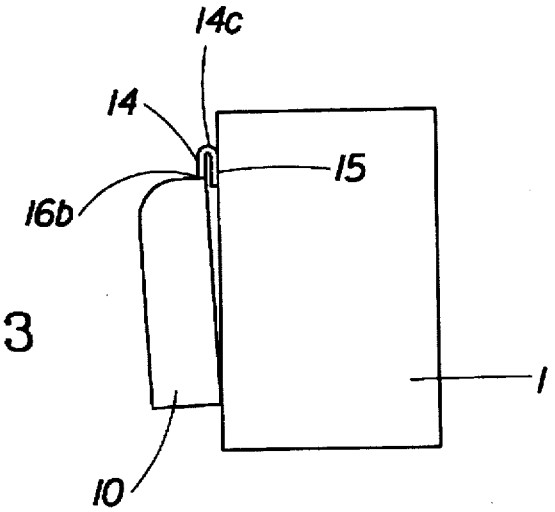

FIG. 13 shows a full open state where the lid 10 is further rotated to about 270 degrees from the closed position to be substantially in contact with the back panel 3 of the box 1. The lid 10 is rotatable about the folding line 16b as described above, whereby the lid 10 can be opened up to the state shown in FIG. 13, without being separated from the box 1.

Figure 14:
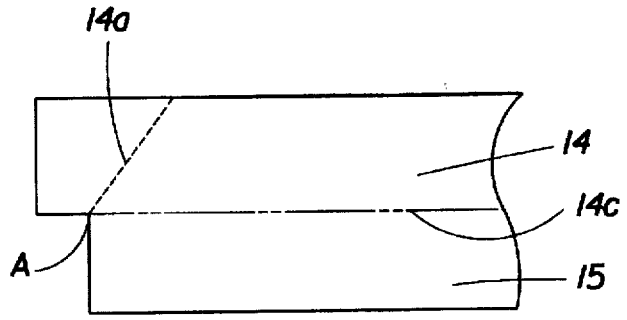
FIGS. 14 to 18 illustrate exemplary cutting lines which are applicable in preferred embodiments.

FIG. 14 shows a cutting line which is similar to that of the embodiment shown in FIG. 1. This figure illustrates a perforation 14a serving as a cutting line which obliquely upwardly extends toward the inner side from a position A where an outer edge portion of a paste flap 15 is in contact with a lower end portion of a back flap 14.

Figure 15:
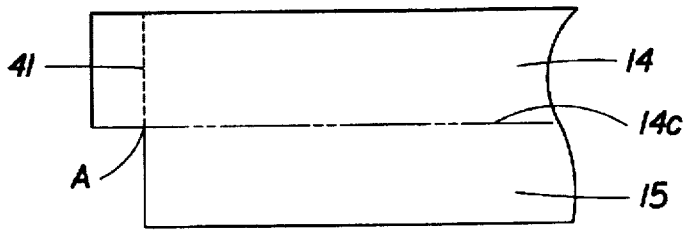

Referring to FIG. 15, this embodiment shows a perforation 41 which upwardly vertically extends from a position A where an outer edge portion of a paste flap 15 is in contact with a lower end portion of a back flap 14.

Figure 16:
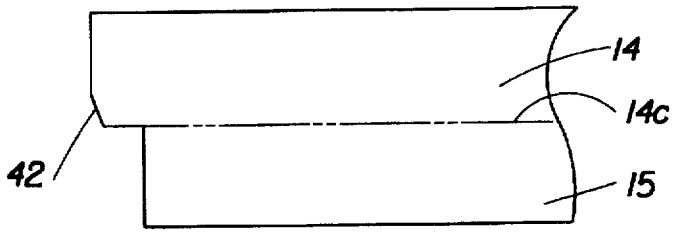
Figure 19:
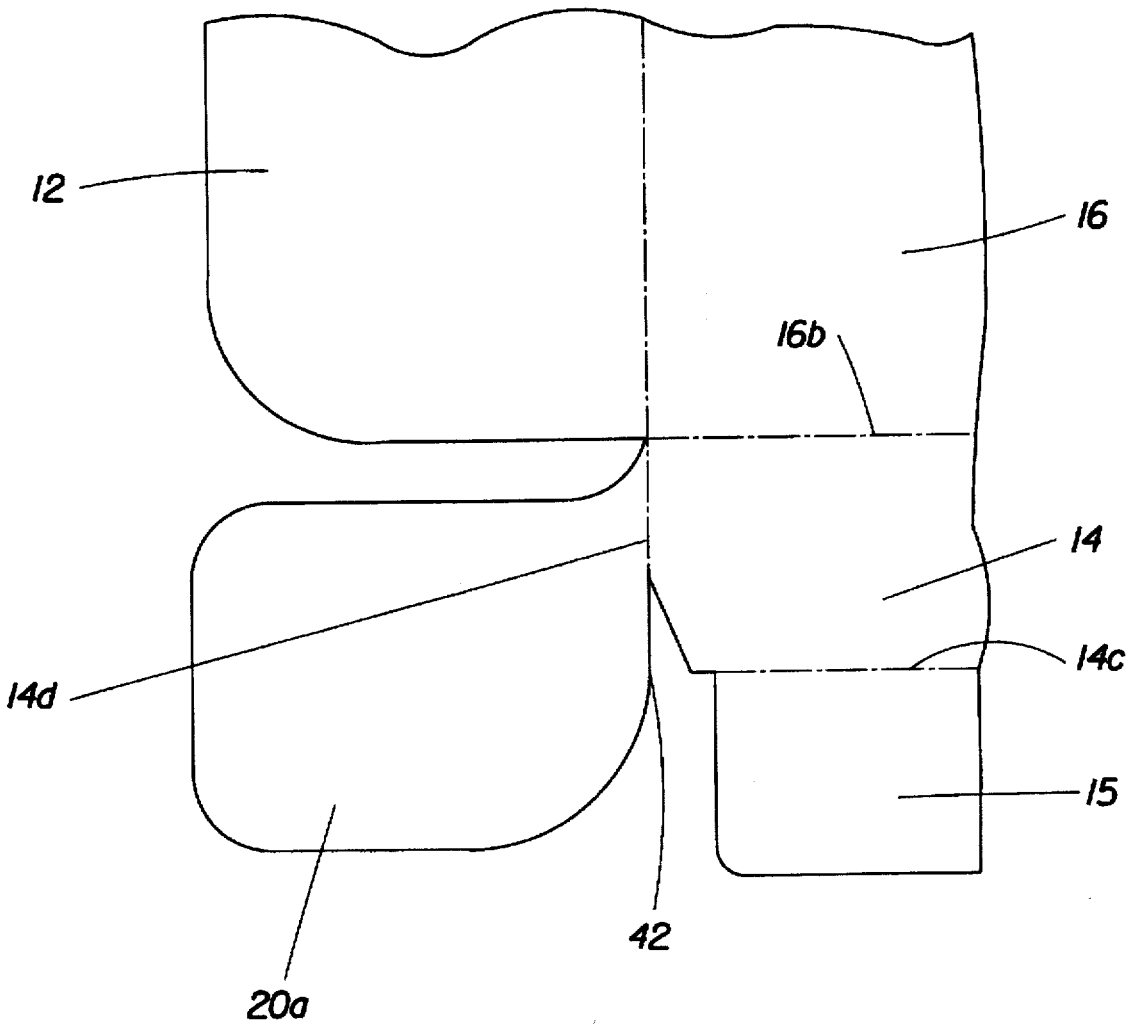
FIG. 19 is a partially enlarged development for the embodiment shown in FIG. 16.

Referring to FIG. 16, a notch 42 is formed in a lower portion of an outer end of a back flap 14 in this embodiment. FIG. 19 is a development of a lid of this embodiment, showing an end portion of the back flap 14 in an enlarged manner. As shown in FIG. 19, a cutting line is defined by a line on an outer end of the back flap 14, and the notch 42 is formed on an end portion of this cutting line. When the lid is rotated in an open direction, stress is concentrated to such a notch 42, so that a complete cutting line is defined along a folding line 14d from the notch 42 serving as a start point. In this embodiment, therefore, the folding line 14d defines the cutting line.

Figure 17:
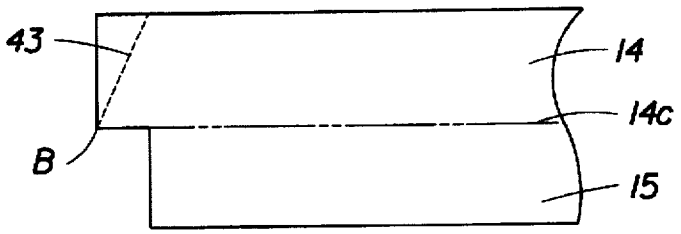

Referring to FIG. 17, a perforation 43 is obliquely formed toward an upper inner side from an outer end B along a lower end portion of a back flap 14 in this embodiment.

Figure 18:
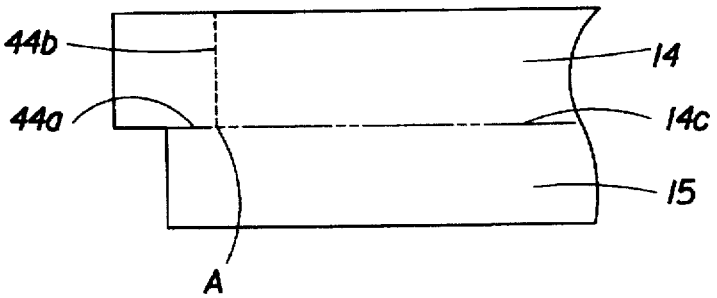

Referring to FIG. 18, an already cut line 44a is formed outside a portion where a paste flap 15 is in contact with a back flap 14 in this embodiment. Therefore, an outer edge portion of the paste flap 15 is in contact with a lower end portion of the back flap 14 at a position A inside the already cut line 44*a*. In this embodiment, a perforation 44*b* is formed to upwardly vertically extend from an inner end portion of such a slit 44*a*.

Each of the aforementioned embodiments employs a perforation or a folding or score line having a notch in place of a cut line which is previously completely cut, since the carton is hard to assemble in the step of assembling the cardboard in the state of the development shown in FIG. 8 if the same is provided with already cut lines. If the already cut lines are formed in the state up to starting of employment after the lid is mounted on the box, further, the side flaps tend to outwardly expand due to the own weight of the contained detergent, to provide an unpreferable appearance on the product. If such points are negligible, the functional effect of the present invention can be sufficiently attained also when already cut lines which are previously completely cut are employed in place of perforations.

Figure 20:
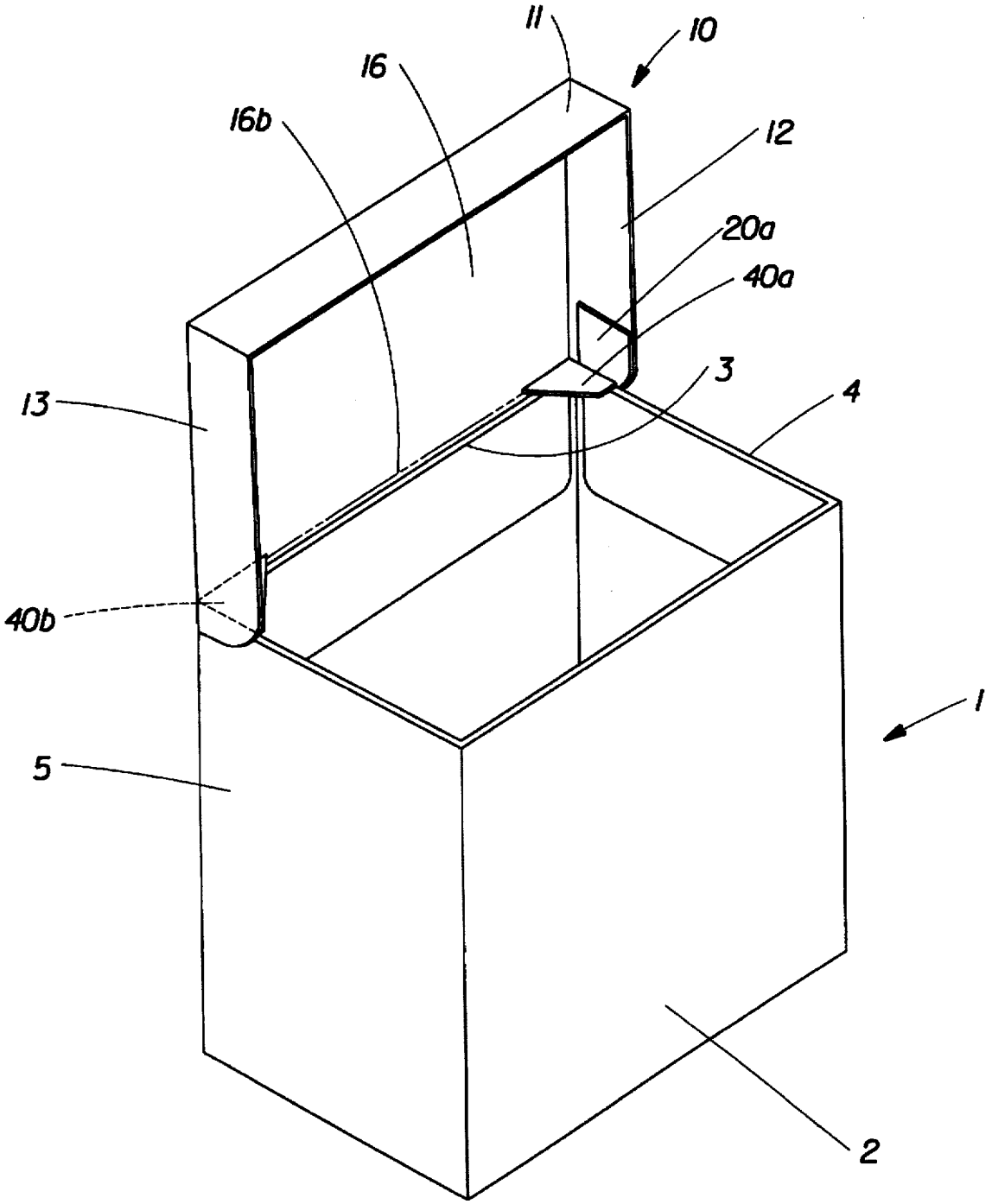
FIG. 20 is a perspective view showing a state of closing the lid while pulling up the same in the embodiment shown in FIG. 1.

FIG. 20 is a perspective view showing a state of closing the lid of the carton shown in FIG. 1 while pulling up the same. When the lid 10 is pulled up to be closed, the rest members 40*a* and 40*b* defined by cutting of the perforations on the back flap may be caught by the upper ends of the back panel 3 and the side panels 4 and 5 of the box 1. In this case, therefore, the rest members 40*a* and 40*b* hinder the operation for closing the lid 10. In order to solve this problem, the cutting lines may be formed on both outer end portions of the back flap, i.e., corner portions between the back flap and the side flaps, to leave no rest members. When the curing lines are formed on these portions, however, absolutely no connecting portions exist between the back flap and the side flaps, and the back flap transversely expands by the own weight of the contained material while the strength of the box serving as an assembled material is lost. Namely, the reinforcing function attained by pasting the auxiliary flaps 20*a* and 20*b* which are provided in continuation to the back flap 14 as shown in FIG. 8 is lost.

Figure 21:
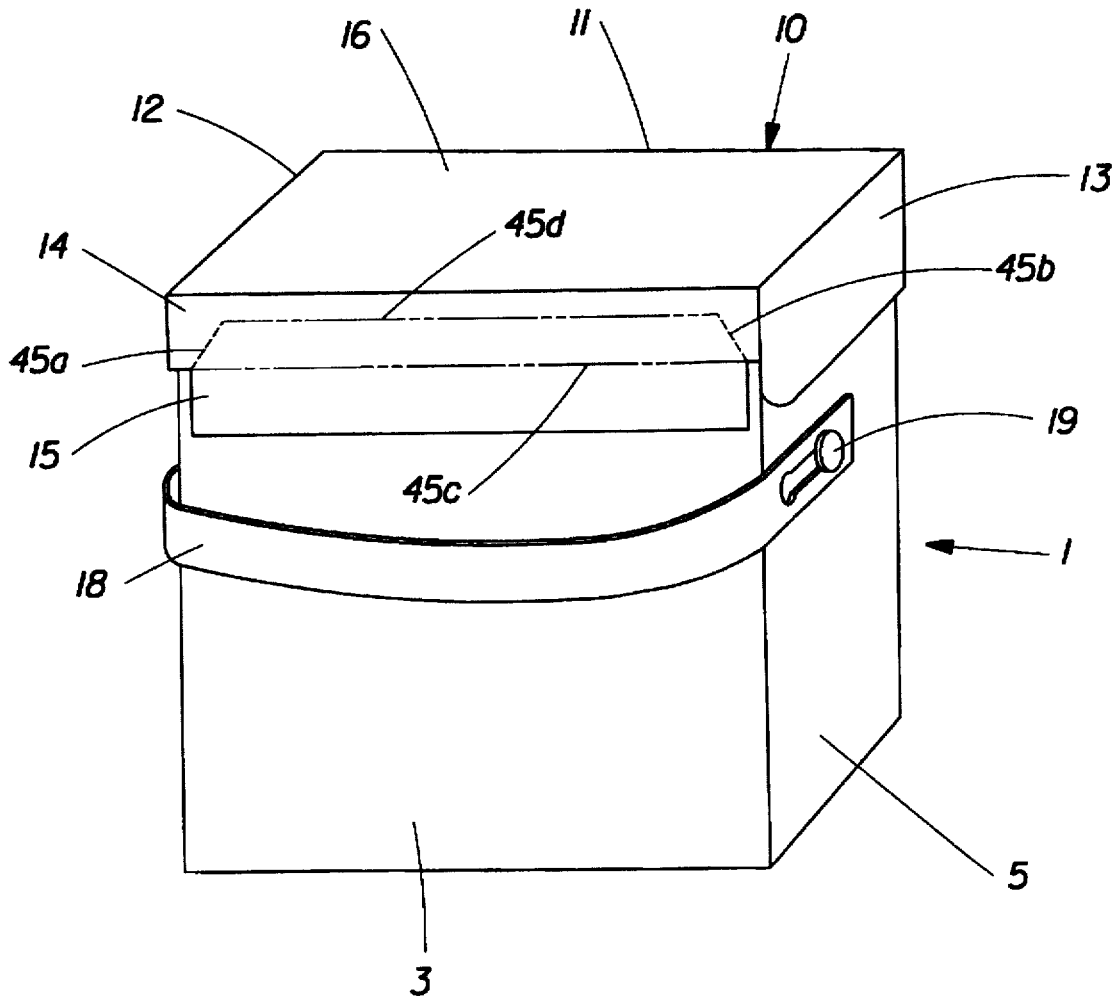
FIG. 21 is a perspective view showing an embodiment according to the second aspect of the present invention.

FIG. 21 is a perspective view showing a carton of one of embodiments according to the second aspect of the present invention, which causes no problem of catching in relation to rest members of a back flap. Referring to FIG. 21, a first hinge line 45*c* is formed between a paste flap 15 and a back flap 14, and a second hinge line 45*d* is formed in a portion of the back flap 14 above the first hinge line 45*c* in parallel with the same according to this embodiment. Further, perforations 45*a* and 45*b* are formed from positions where outer edge portions of the paste flap 15 are in contact with lower end portions of the back flap 14 to reach the second hinge line 45*d*. The remaining structures of this embodiment are denoted by the same reference numerals as those of the embodiment shown in FIG. 1, to omit redundant description.

Figure 22:
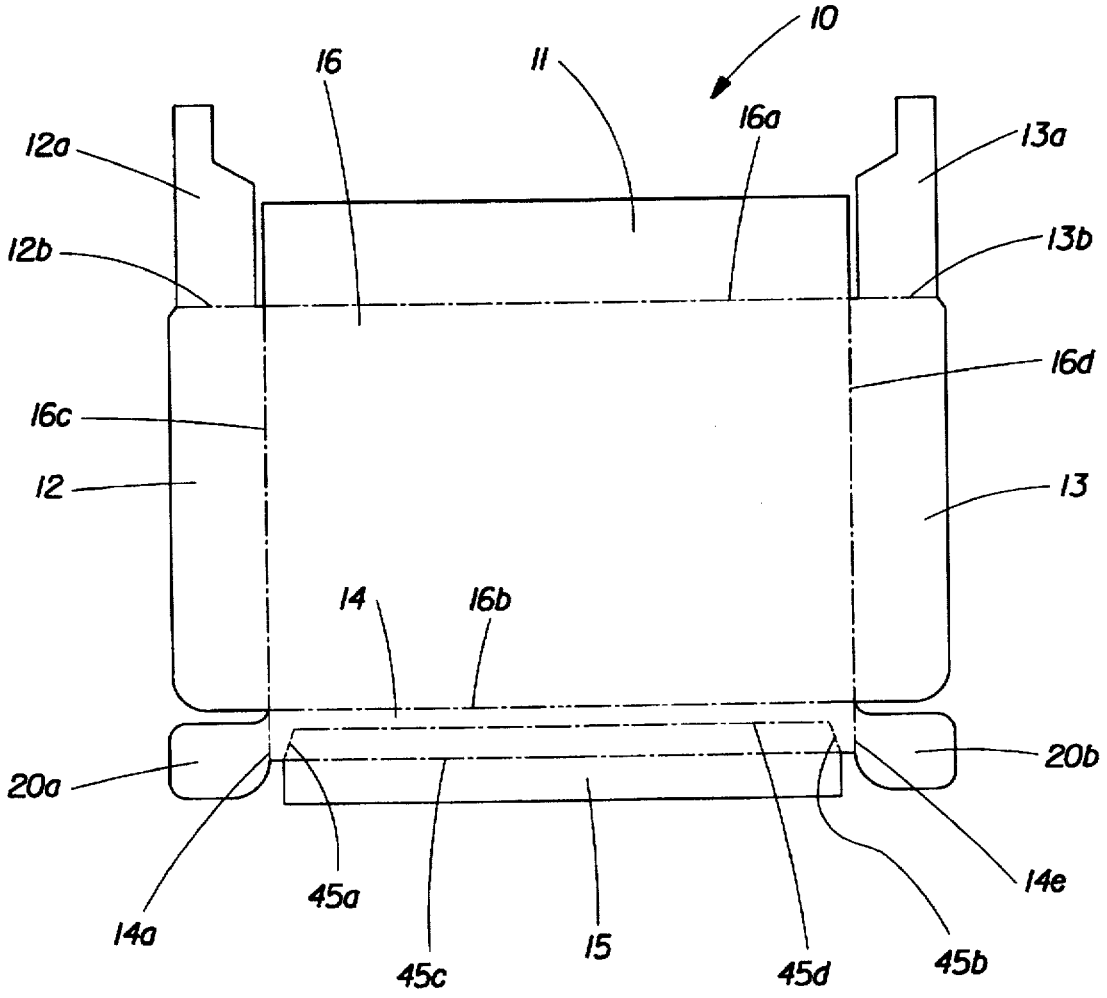
FIG. 22 is a development of a lid shown in FIG. 21.

As shown in FIG. 22, the first hinge line 45 is formed between the back flap 14 and the paste flap 15, and the second hinge line 45*d* is formed between the first hinge line 45*c* and a folding line 16*b*. While the first and second hinge lines 45*c* and 45*d* are formed as folding lines in this embodiment, discontinuously cut perforations, for example, may selectively be formed in place of the folding lines, to further facilitate bending.

Further, the perforations 45*a* and 45*b* are formed from the positions where the outer edge portions of the paste flap 15 are in contact with the lower end portions of the back flap 14, to reach end portions of the second hinge line 45*d*. The remaining structures are denoted by the same reference numerals as those in the development shown in FIG. 8, to omit redundant description.

Figure 23:
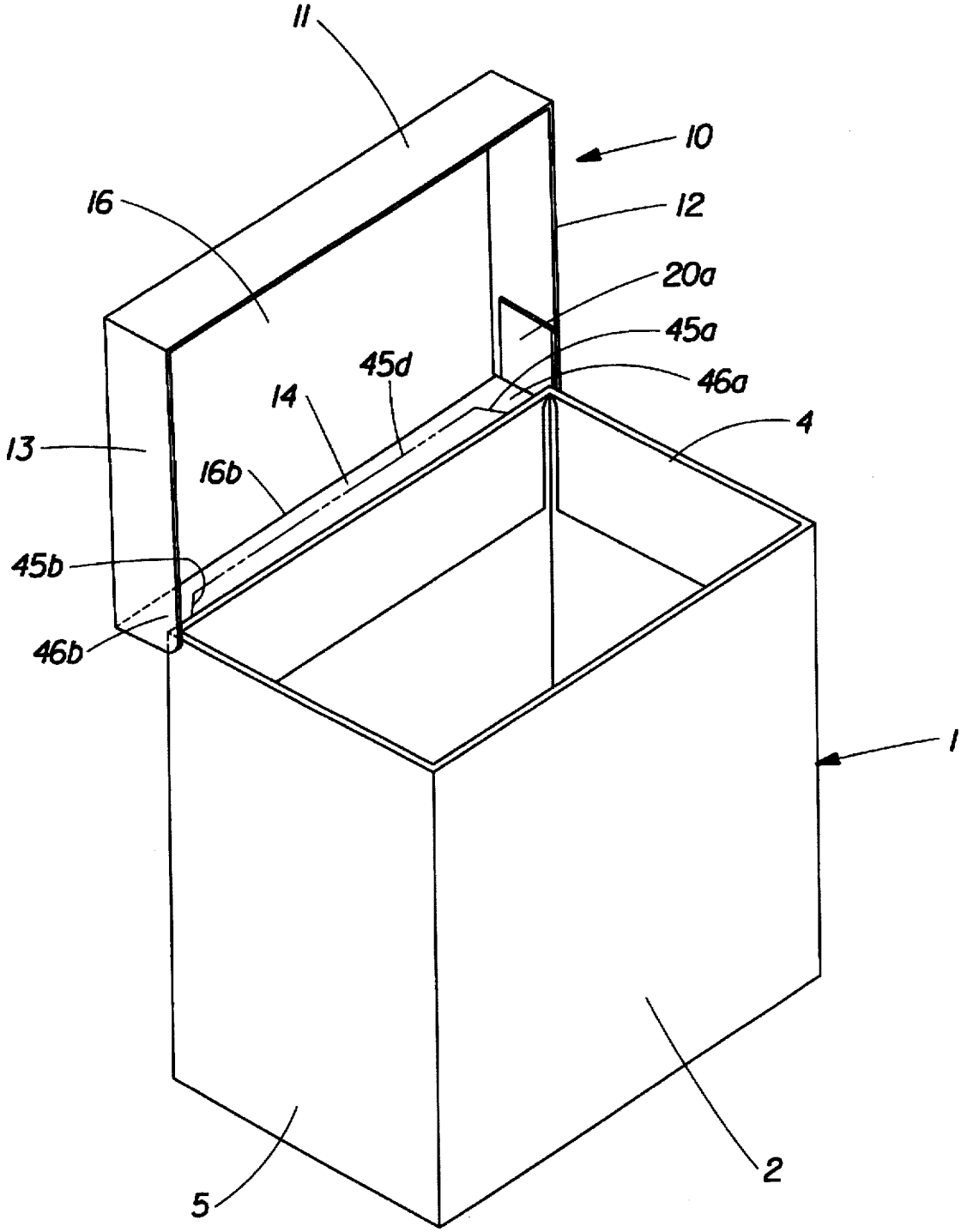
FIG. 23 is a perspective view showing a state of opening the lid in the embodiment shown in FIG. 21.

FIG. 23 shows a state where the lid of the carton according to the embodiment shown in FIG. 21 is opened up to the vertical direction, i.e., to be at an angle of about 90 from the closed position. When the lid 10 is further opened from this state, stress caused by the rotation of the lid 10 acts on the back flap 14 from a state where the lid 10 is in a substantially horizontal direction, i.e., the lid 10 is opened at an angle of about 180 degrees, similarly to the aforementioned embodiment shown in FIG. 1. When the lid 10 is further opened, complete cutting lines are defined along the perforations 45*a* and 45*b* due to such stress caused by the rotation.

Figure 24:
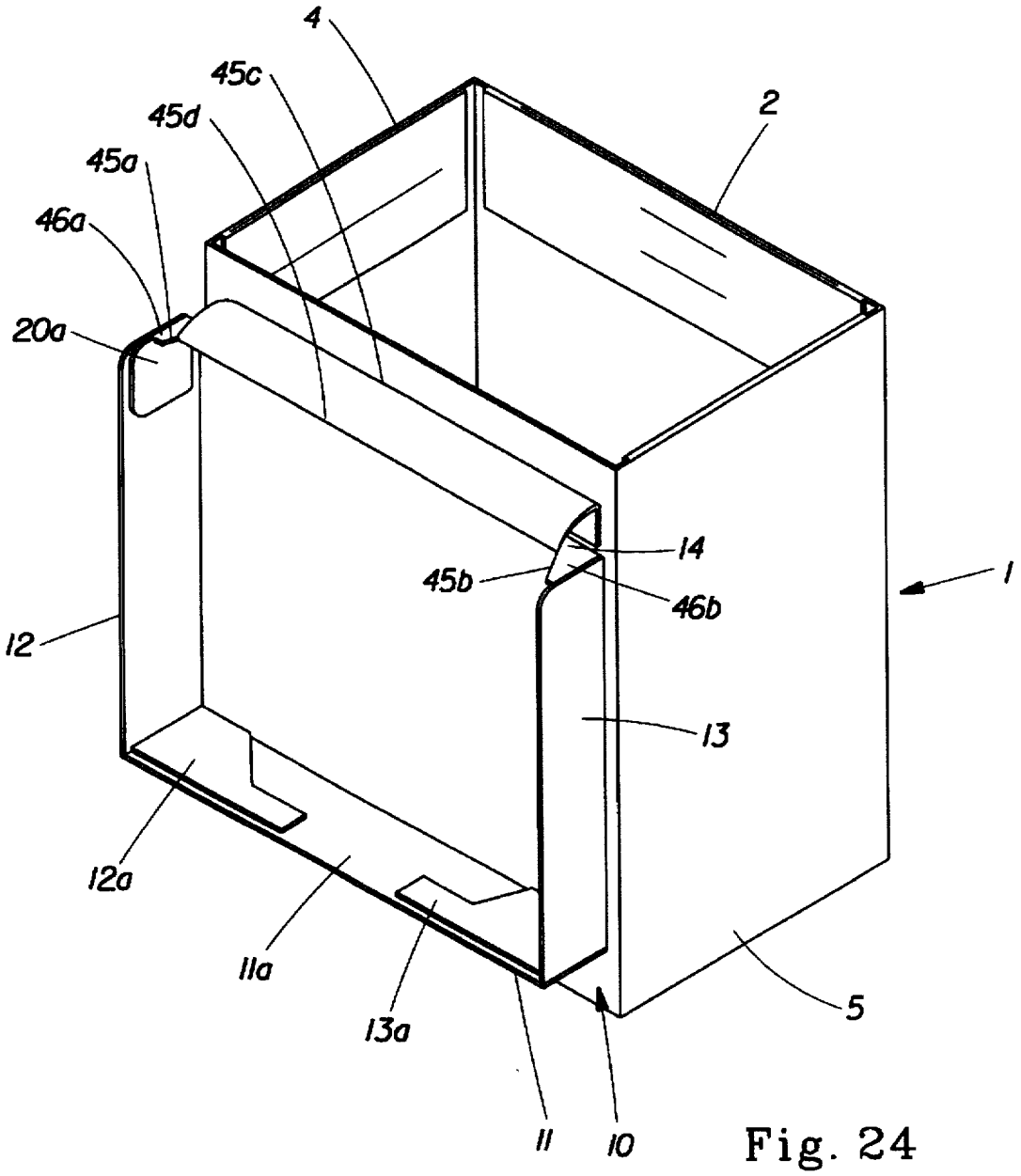
FIG. 24 is a perspective view showing a state of fully opening the lid in the embodiment shown in FIG. 21.

FIG. 24 shows a state where the lid 10 is further opened to a substantially full open state. When the perforations 45*a* and 45*b* are cut, the lid 10 is rotatable about the second hinge line 45*d* connecting the end portions of the perforations with each other. Thus, the lid 10 becomes rotatable up to the full open state, as shown in FIG. 24.

Figure 25:
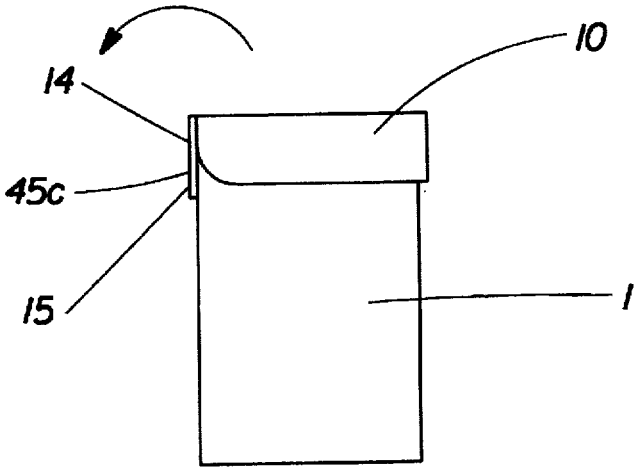
FIGS. 25 to 27 are side elevational views for illustrating states of rotation of the lid in the embodiment according to the second aspect of the present invention.

FIG. 25 shows a closed state of the lid 10. When the lid 10 is opened from this state, the lid 10 is rotated about the first hinge line 45*c* which is formed between the paste flap 15 and the back flap 14.

Figure 26:
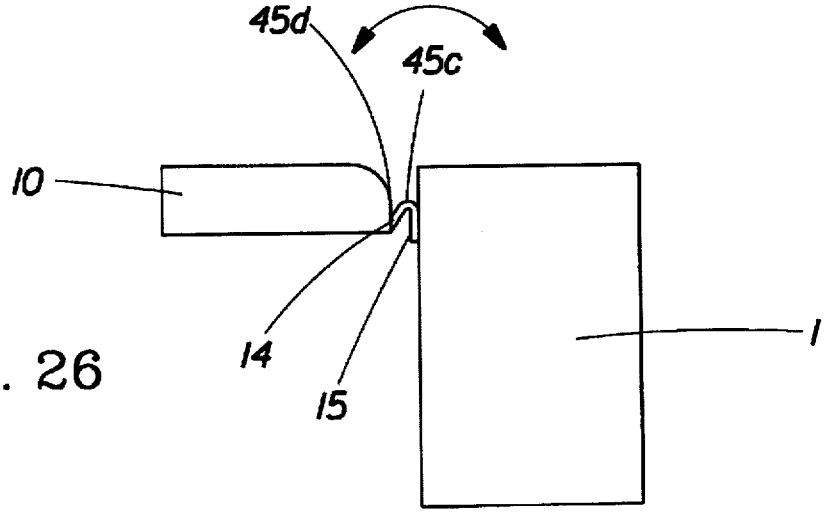

FIG. 26 shows a substantially horizontal state of the lid 10, i.e., a state where the lid 10 is opened up to an angle of 180 degrees from the closed state. From this state, formation of complete cutting lines is started along the perforations 45*a* and 45*b*, as described above. When continuous cutting lines are formed along the perforations, the lid 10 is rotatable about the second hinge line 45*d* which is positioned on end portions of the perforations.

Figure 27:
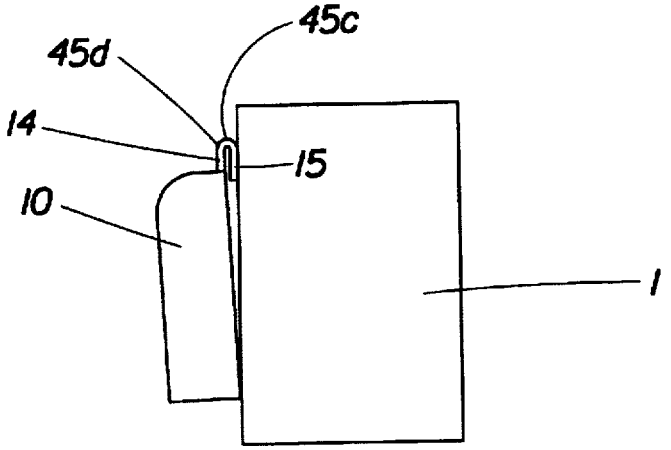

FIG. 27 shows a state where the lid 10 is rotated to a full open state, i.e., up to an angle of about 270 degrees. The lid 10 is rotated about the second hinge line 45*d* from the state shown in FIG. 26, whereby the lid 10 can be rotated up to the full open state shown in FIG. 27 with no separation from the box 1.

According to the second aspect of the present invention, no problem of catching by the rest members of the back flap is caused dissimilarly to the embodiment of the first aspect shown in FIG. 1. Referring to FIG. 23, the lid 10 is rotated about the second hinge line 45*d* in this embodiment, when the lid 10 is pulled up to be closed. The second hinge line 45*d* is positioned downward beyond a folding line 16*b* which is provided between the back flap 14 and a top panel 16, whereby the rest members 46*a* and 46*b* are not moved to an upper portion of the box 1. Thus, the lid 10 can be closed with no problem of catching by the rest members 46*a* and 46*b*.

Figure 28:
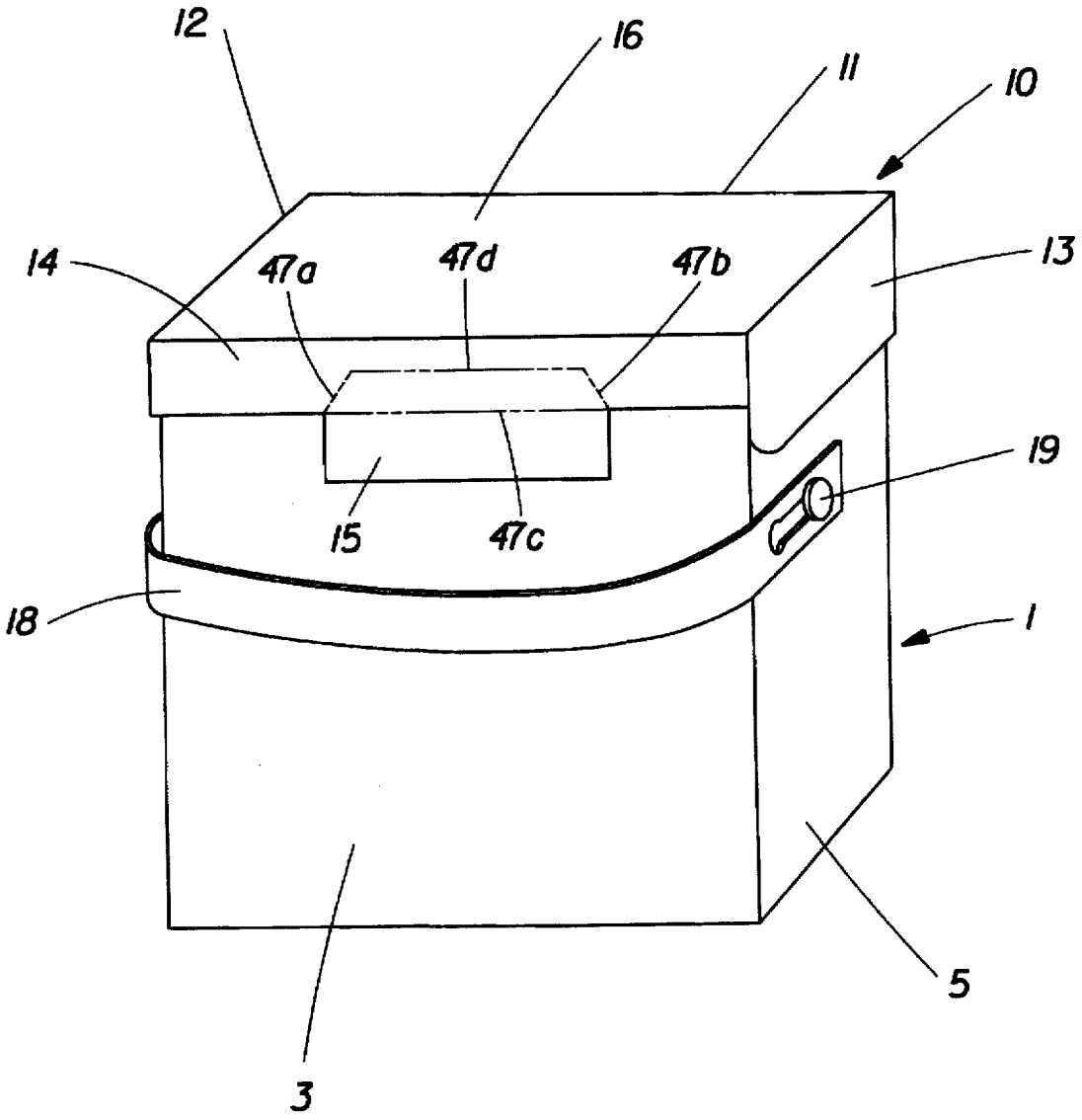
FIGS. 28 to 34 are perspective views showing further embodiments according to the second aspect of the present invention.

FIG. 28 is a perspective view showing another embodiment according to the second aspect of the present invention from behind the carton. Referring to FIG. 28, a narrower paste flap 15 is employed in this embodiment. A first hinge line 47*c* is formed between the paste flap 15 and a back flap 14, while a second hinge line 47*d* is formed above the first hinge line 47*c*. Perforations 47*a* and 47*b* serving as cutting lines are formed from both end portions of the first hinge line 47*c* to reach both end portions of the second hinge line 47*d* respectively. Also in this embodiment, the perforations 47*a* and 47*b* are cut by opening the lid 10, whereby the lid 10 can be rotated about the second hinge line 47*d*.

Figure 29:
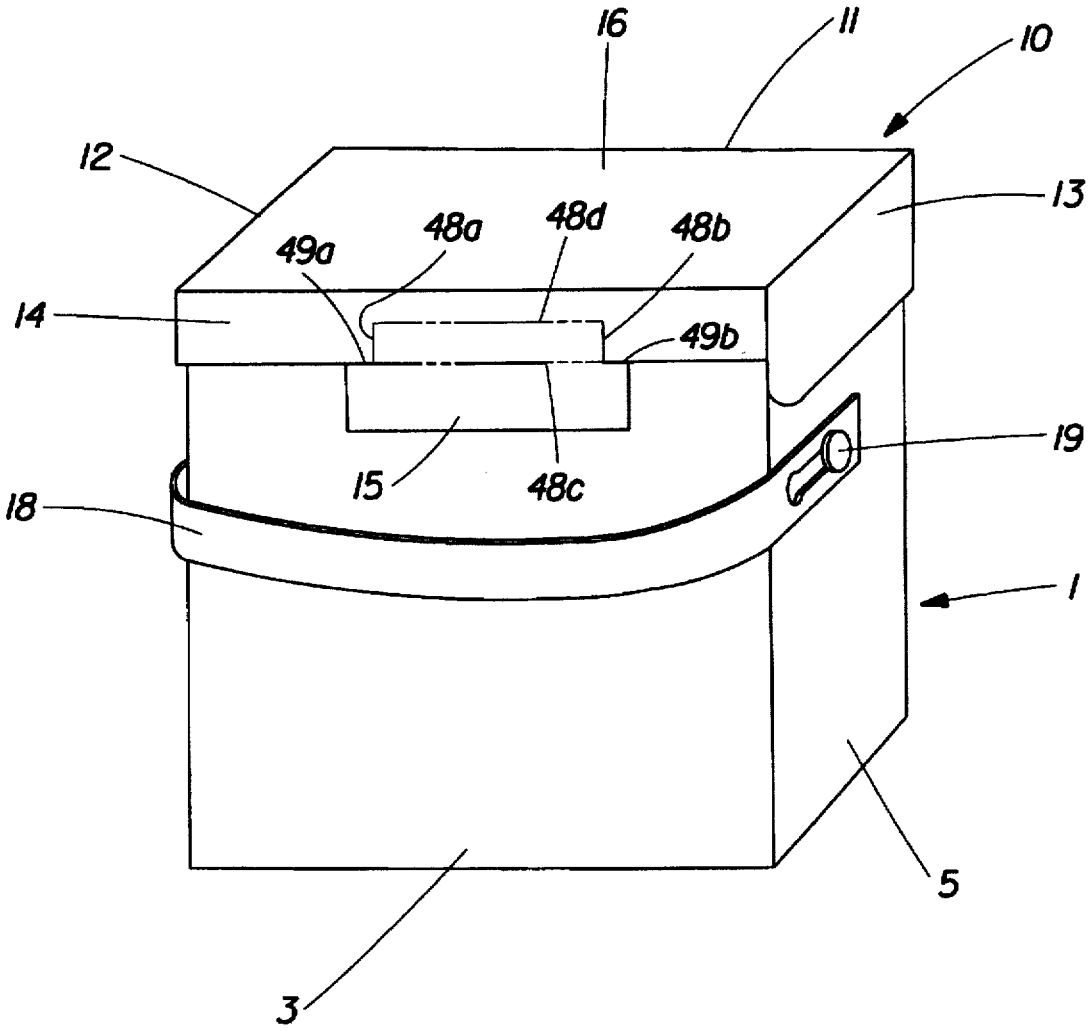

FIG. 29 is a perspective view showing still another embodiment according to the second aspect of the present invention. Referring to FIG. 29, complete cut lines 49*a* and 49*b* are formed to inwardly extend in a boundary portion between a paste flap 15 and a back flap 14 in this embodiment. According to this embodiment, therefore, outer edge portions of the paste flap 15 are in contact with lower end portions of the back flap 14 in inner end portions of the complete cut lines 49*a* and 49*b*. In this embodiment, perforations 48*a* and 48*b* serving as cutting lines extend from the inner end portions of the complete cut lines 49*a* and 49*b* to reach end portions of a second hinge line 48*d*. A first hinge line 48*c* is formed between the inner end portions of the complete cut lines 49*a* and 49*b*.

Figure 30:
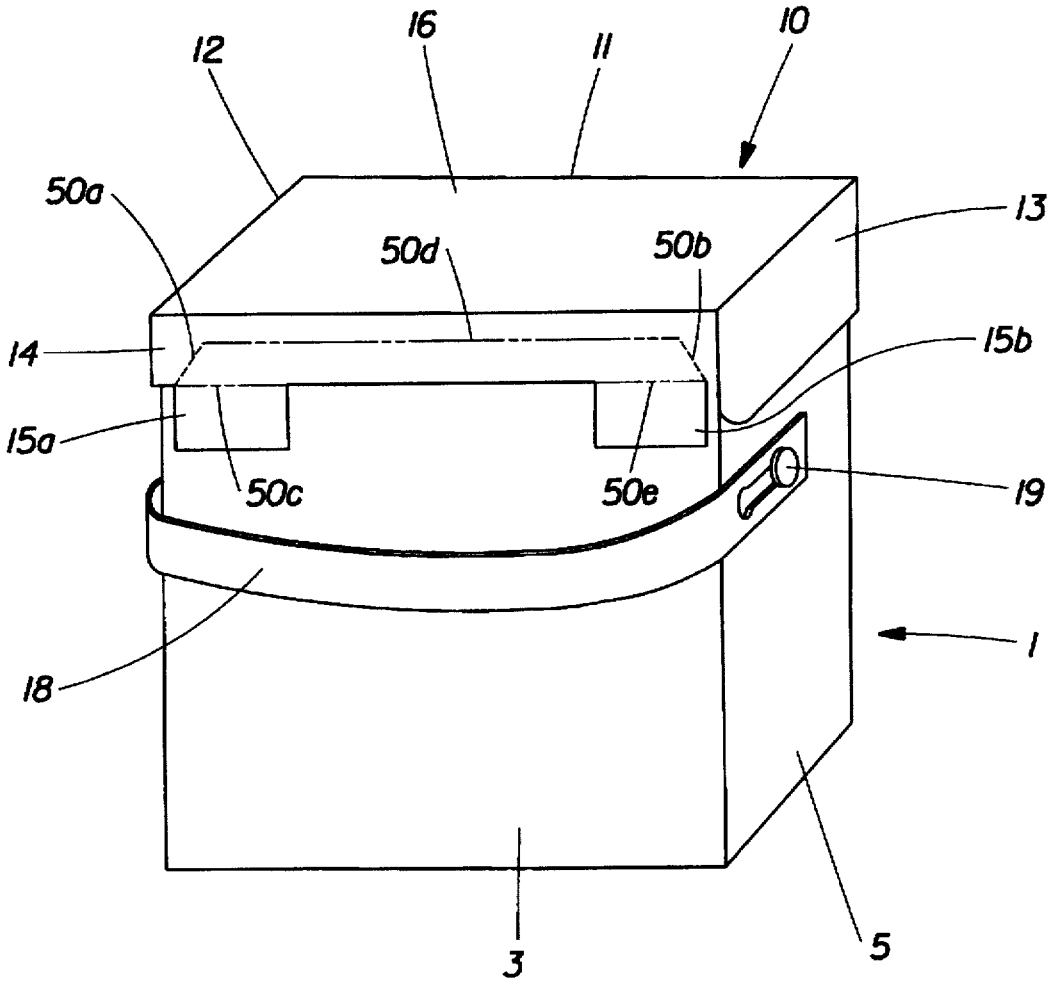

FIG. 30 is a perspective view showing a further embodiment according to the second aspect of the present invention. This embodiment is provided with two paste flaps 15*a* and 15*b*. First hinge lines 50*c* and 50*e* are formed between the two paste flaps 15*a* and 15*b* and a back flap 14 respectively. A second hinge line 50*d* is formed above the first hinge lines 50*c* and 50*e*. A perforation 50*a* serving as a cutting line is formed from an outer end portion of the first hinge line 15*a*, to reach an end portion of the second hinge line 50*d*. On the other hand, another perforation 50*b* serving as a cutting line is formed from an outer end portion of the other paste flap 15*b* to reach another end portion of the second hinge line 50*d*.

Figure 31:
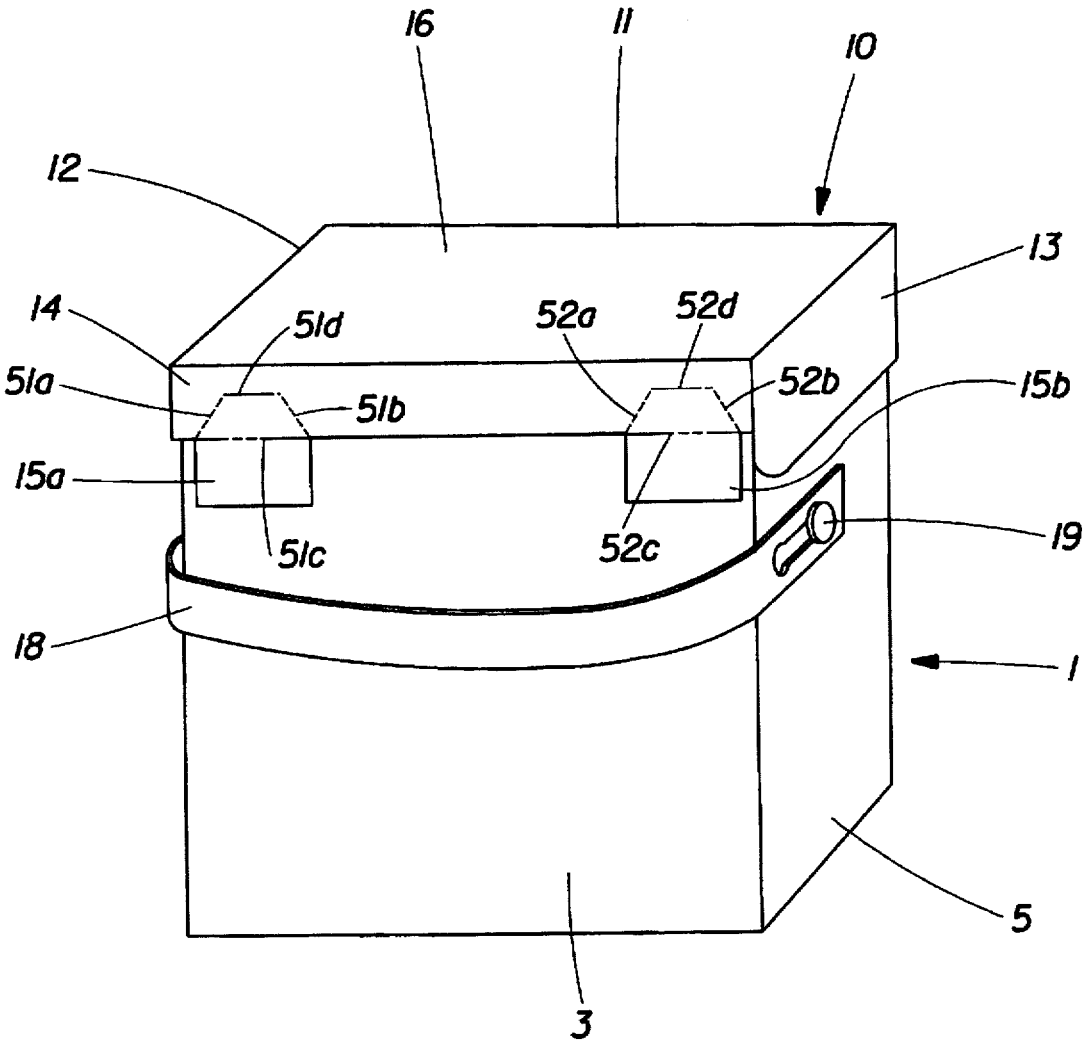

FIG. 31 is a perspective view showing a further embodiment according to the second aspect of the present invention. This embodiment is provided with two paste flaps 15*a* and 15*b*, similarly to the embodiment shown in FIG. 30. First hinge lines 51*c* and 52*c* are formed between the flaps 15*a* and 15*b* and a back flap 14 respectively. Further, second hinge lines 51*d* and 52*d* are formed above the first hinge lines 51*c* and 52*d* respectively. Perforations 51*a* and 51*b* serving as cutting lines are formed from upper end portions of the paste flap 15*a* to reach corresponding end portions of the second hinge line 51*d* respectively. Also in the paste flap 15*b*, cutting perforations 52*a* and 52*b* are formed from upper end portions of the paste flap 15*b* to reach corresponding end portions of the second hinge line 52*d* respectively.

As understood from the embodiments shown in FIGS. 30 and 31, the paste flap provided in the present invention is not restricted to one but a plurality of paste flaps can be provided. The cutting lines may be provided in a pair for each paste flap (FIG. 31), or to form a pair as a whole (FIG. 30).

Figure 32:
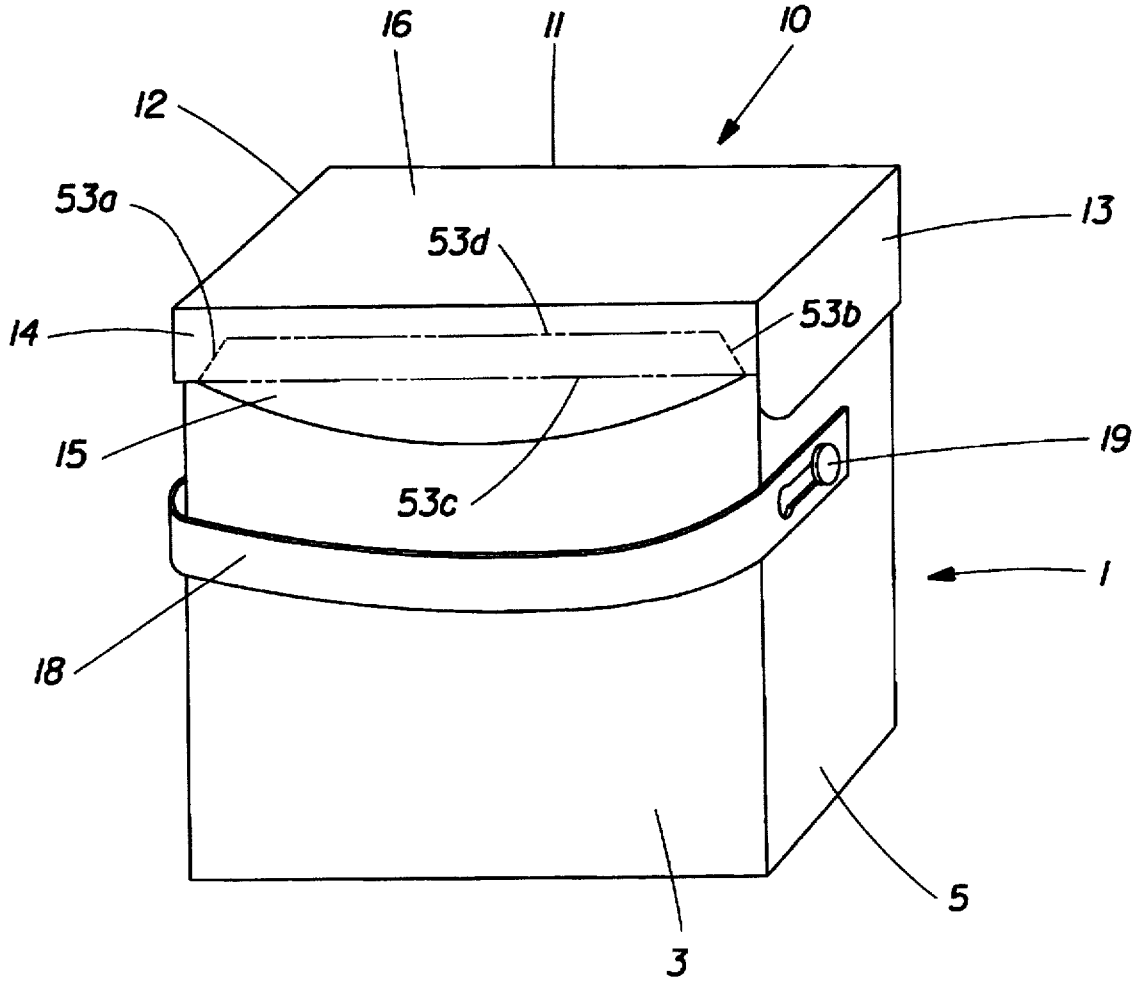

FIG. 32 is a perspective view showing a further embodiment according to the second aspect of the present invention. This embodiment is provided with a paste flap 15 whose lower end portion has a curved shape. A first hinge line 53*c* is formed between a back flap 14 and the paste flap 15. A second hinge line 53*d* is formed above the first hinge line 53*c*. Perforations 53*a* and 53*b* serving as cutting lines are formed from positions where outer edge portions of the paste flap 15 are in contact with lower end portions of the back flap 14 to reach end portions of the second hinge line 53*d* respectively.

Figure 33:
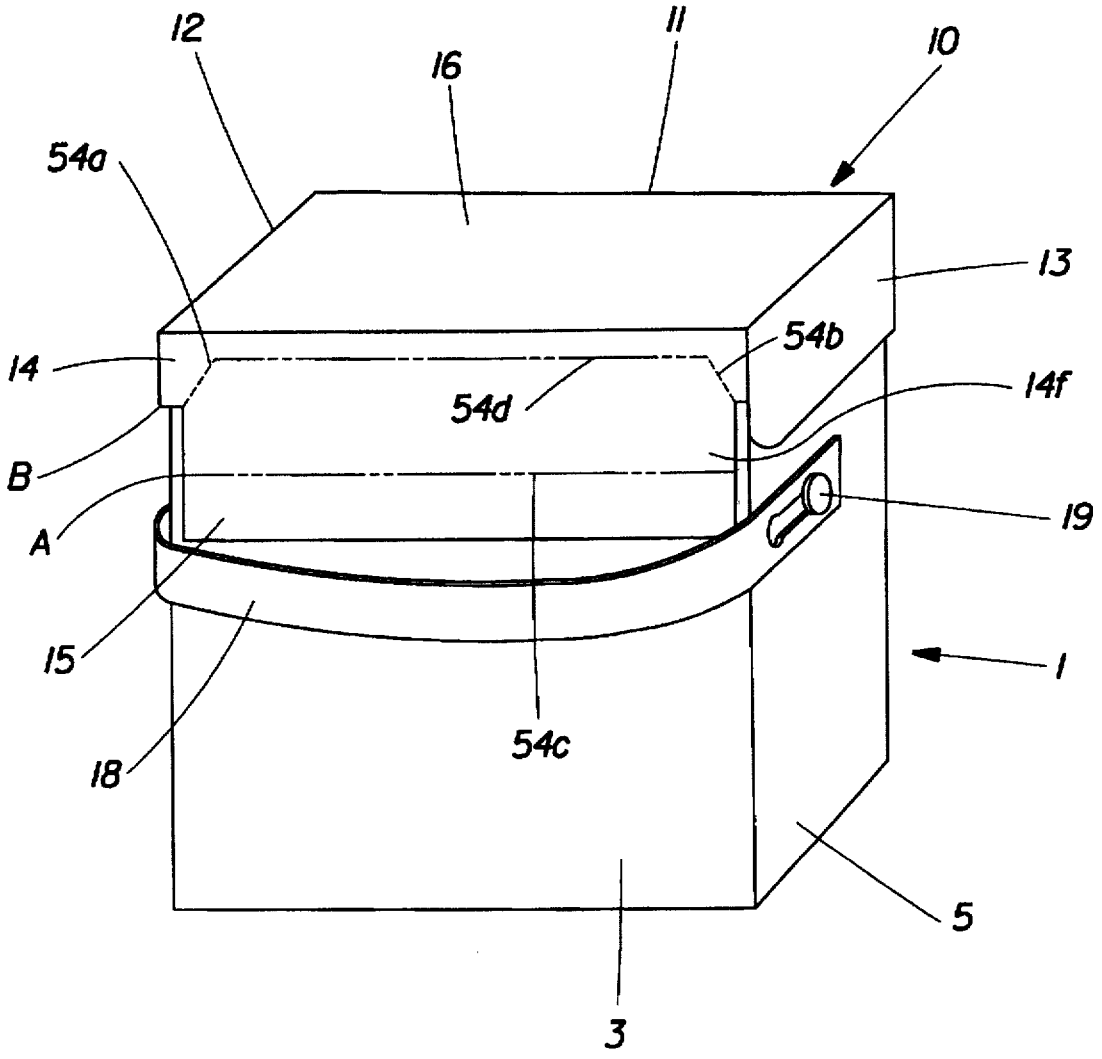

FIG. 33 is a perspective view showing a further embodiment according to the second aspect of the present invention. In this embodiment, a lower portion 14*f* of a back flap 14 is narrowed to be identical in width to a paste flap 15. The back flap 14 is increased in vertical length, and hence the paste flap 15 is mounted on a relatively lower portion. A first hinge line 54*c* is formed between the paste flap 15 and the back flap 14. A second hinge line 54*d* is formed above the first hinge line 54*c*. Perforations 54*a* and 54*b* which are cutting lines are formed from corner portions of the narrow lower portion 14*f* of the back flap 14 to reach end portions of the second hinge line 54*d* respectively. In this embodiment, an outer edge portion of the paste flap 15 is in contact with a lower end portion of the back flap 14 at a position A which is flush with the first hinge line 54*c*, whereby the cutting lines 54*a* and 54*b* are formed to extend from positions up to outer ends B along the lower end portion of the back flap 14 from the position A.

Figure 34:
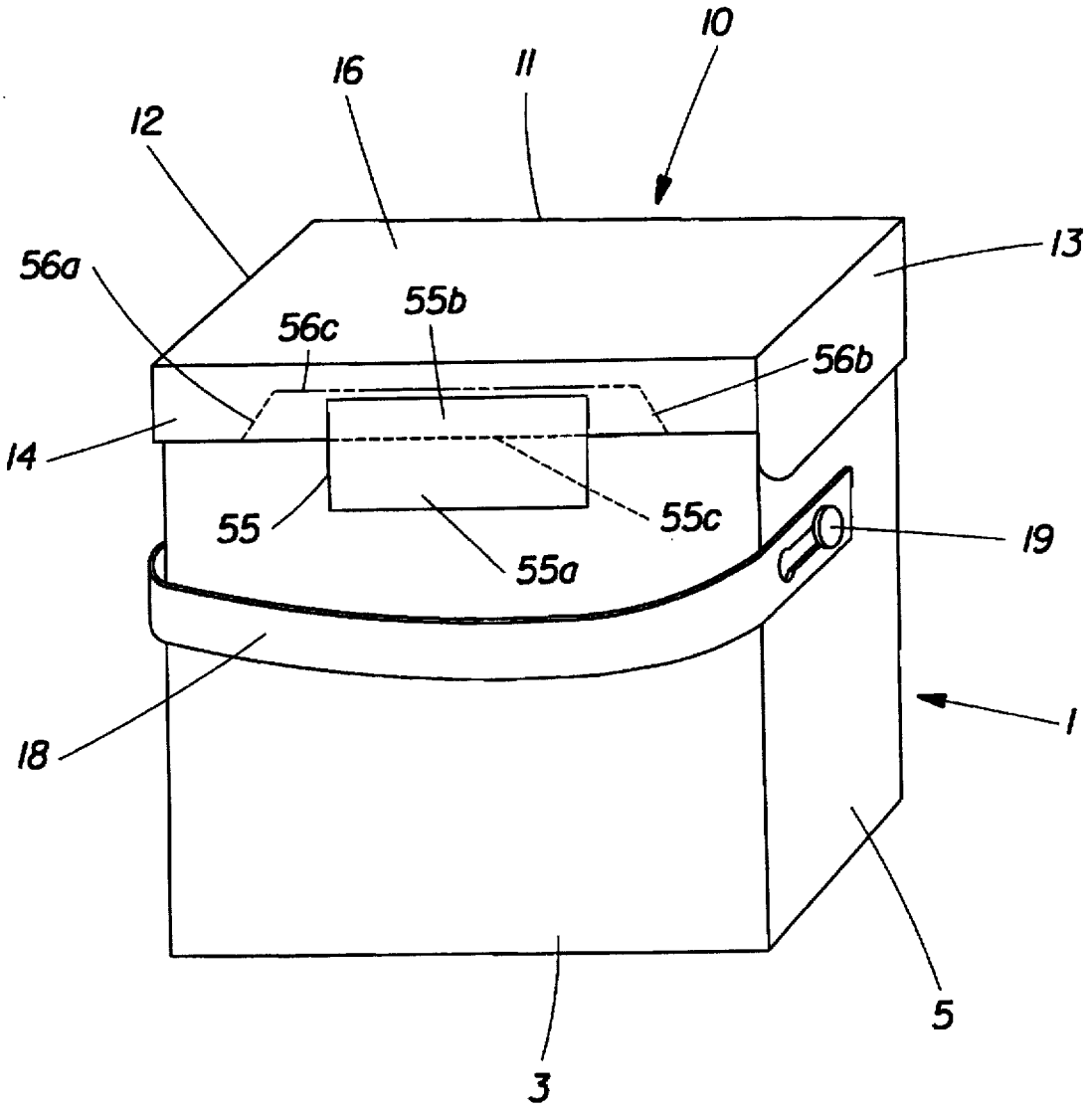

FIG. 34 is a perspective view showing a further embodiment according to the second aspect of the present invention. In this embodiment, an adhesive seal 55 is pasted on a portion under the center of a back flap 14. Due to such pasting of the adhesive seal 5, a lower portion 55*a* of the adhesive seal 55 positioned under the back flap 14 defines a paste flap. On the other hand, an upper portion 55*b* of the adhesive seal 55 is pasted on the back flap 14. A boundary portion 55*c* between the adhesive seal upper portion 55*b* and the adhesive seal lower portion 55*a* serving as a paste flap defines a first hinge line.

A second hinge line 56*c* is formed in a portion of the back flap 14 above the boundary portion 55*c* defining the first hinge line. Perforations 56*a* and 56*b* serving as cutting lines are formed from lower end portions of the back flap 14 outside the adhesive seal 55 to reach the second hinge line 56*c* respectively.

Also when the paste flap is formed by an adhesive seal similarly to this embodiment, a lid 10 can be brought into a full open state with no separation of the adhesive seal by forming the second hinge line 56 while forming the perforations 56*a* and 56*b* which are connected with both ends thereof respectively.

According to the present invention, the paste flap may be formed by an independent part such as an adhesive seal, similarly to the aforementioned embodiment shown in FIG. 34. Formation of the paste flap by such an adhesive seal can also be employed in the first aspect of the present invention shown in FIG. 1.

The structure of the box in the carton according to the present invention is not restricted to any of the aforementioned embodiments. Therefore, the box and the lid of the carton according to the present invention may not have a locking structure dissimilarly to the above embodiments.

While the above embodiments have been described with reference to cartons which are formed by cardboards, the material for the inventive carton is not particularly restricted so far as the same can form a carton. For example, at least one of the lid and the box can be formed by a plastic sheet or the like.

What is claimed is:

1. A carton for containing granular materials, comprising:

a box having front, back and side panels to form an opening; and a lid attached to an upper portion of said back panel for closing said opening; wherein said lid comprises:

(a) a top panel for covering said opening upon closure of said lid;

(b) front and side flaps extending from the respective edges of said top panel for covering the respective upper portions of said front and side panels upon closure of said lid;

(c) an adhesion flap adhering to said back panel; and (d) a back flap attached to said top panel and said adhesion flap, wherein a cutting line which is extending toward said top panel is formed at least in said back flap.

2. The carton of claim 1, wherein said cutting line is so formed as to reach an upper end portion of said back flap.

3. The carton of claim 1, wherein said back flap is hingedly attached to said adhesion flap through a first hinge line.

4. The carton of claim 3, wherein a second hinge line is formed in said back flap above said first hinge line, and said cutting line is formed up to said second hinge line.

5. The carton of claim 1, wherein said cutting line is a cutting auxiliary line for aiding an actual cutting during an operation of opening said lid.

6. The carton of claim 5, wherein said cutting auxiliary line is a partial cutting line being formed by partially cutting the overall area of said cutting line.

7. The carton of claim 5, wherein said cutting auxiliary line is a holding or score line which has a notch at a cutting start point.

8. The carton of claim 4, wherein said cutting line is a pre-cut line being formed by continuously cutting the overall area of said cutting line.

* * * * *